US010578248B2

(12) United States Patent
Delanoe et al.

(10) Patent No.: US 10,578,248 B2
(45) Date of Patent: Mar. 3, 2020

(54) SEALED AND THERMALLY INSULATING TANK

(71) Applicant: GAZTRANSPORT ET TECHNIGAZ, Saint Remy les Chevreuse (FR)

(72) Inventors: Sébastien Delanoe, Saint Remy les Chevreuse (FR); Anthony De Faria, Villeparisis (FR); Vincent Berger, Bullion (FR); François Durand, Elancourt (FR)

(73) Assignee: GAZTRANSPORT EY TECHNIGAZ, Saint Remy les Chevreuse (FR)

( * ) Notice: Subject to any disclaimer, the term of this patent is extended or adjusted under 35 U.S.C. 154(b) by 0 days.

(21) Appl. No.: 15/741,184

(22) PCT Filed: Oct. 13, 2016

(86) PCT No.: PCT/FR2016/052648
§ 371 (c)(1),
(2) Date: Dec. 29, 2017

(87) PCT Pub. No.: WO2017/064426
PCT Pub. Date: Apr. 20, 2017

(65) Prior Publication Data

US 2018/0216782 A1 Aug. 2, 2018

(30) Foreign Application Priority Data

Oct. 13, 2015 (FR) ..... 15 59744

(51) Int. Cl.
*B63B 25/08* (2006.01)
*B63B 3/02* (2006.01)
(Continued)

(52) U.S. Cl.
CPC ..... *F17C 3/027* (2013.01); *B63B 25/08* (2013.01); *F17C 13/001* (2013.01);
(Continued)

(58) Field of Classification Search
CPC ..... B63B 3/62; B63B 3/68; B63B 17/0027; B63B 25/08; B63B 25/12; B63B 25/14;
(Continued)

(56) References Cited

U.S. PATENT DOCUMENTS 4,021,982 A * 5/1977 Kotcharian ..... F16L 59/02 220/592.26
4,207,827 A * 6/1980 Gondouin ..... B63B 9/06 114/74 A
(Continued)

FOREIGN PATENT DOCUMENTS

FR 2781557 A1 1/2000
FR 2996520 A1 4/2014
(Continued)

*Primary Examiner* — Daniel V Venne
(74) *Attorney, Agent, or Firm* — Berenato & White, LLC

(57) ABSTRACT

Sealed and thermally insulating tank comprising a sealed membrane and a thermally insulating barrier with insulating blocks comprising cover panels, the sealed membrane being made up of a corrugated metal membrane comprising a series of parallel corrugations and flat portions between the corrugations and resting on the cover panels, wherein an insulating block is twice the pitch of the corrugations, meaning that a series of corrugations comprises a pair of corrugations situated in line with one insulating block, and wherein the flat portions of the sealed membrane are arranged in line with an internal zone of the cover panels, the sealed membrane being fixed to the thermally insulating barrier by fixing the flat portions of the sealed membrane to the insulating blocks in the internal zone of the cover panels.

25 Claims, 9 Drawing Sheets

(51) Int. Cl.
*F17C 3/02* (2006.01)
*F17C 13/00* (2006.01)

(52) U.S. Cl.
CPC ..... *F17C 2201/0157* (2013.01); *F17C 2201/052* (2013.01); *F17C 2203/012* (2013.01); *F17C 2203/035* (2013.01); *F17C 2203/0329* (2013.01); *F17C 2203/0333* (2013.01); *F17C 2203/0341* (2013.01); *F17C 2203/0358* (2013.01); *F17C 2203/0379* (2013.01); *F17C 2203/0631* (2013.01); *F17C 2203/0651* (2013.01); *F17C 2205/018* (2013.01); *F17C 2221/033* (2013.01); *F17C 2221/035* (2013.01); *F17C 2223/0153* (2013.01); *F17C 2223/0161* (2013.01); *F17C 2223/033* (2013.01); *F17C 2260/011* (2013.01); *F17C 2270/0107* (2013.01)

(58) Field of Classification Search
CPC ... B63B 25/16; B63B 25/26; B63B 2025/022; B63B 2025/025; B63B 2025/027; B63B 2025/08; B63B 2025/085; B63B 2025/087; F17C 3/027; F17C 13/001; F17C 2201/0157; F17C 2201/052; F17C 2203/012; F17C 2203/0358; F17C 2203/0329; F17C 2221/033; F17C 2221/035; F17C 2223/0161; F17C 2223/033; F17C 2260/011; F17C 2270/0107; F17C 2203/0631
USPC ..... 114/75, 73, 74 R, 74 T, 74 A
See application file for complete search history.

(56) References Cited

U.S. PATENT DOCUMENTS

| | | | | |
|---|---|---|---|---|
| 6,035,795 | A | 3/2000 | Dhellemmes et al. | |
| 9,440,712 | B2 | 9/2016 | Bougault et al. | |
| 9,518,700 | B2 | 12/2016 | Herry et al. | |
| 2007/0194051 | A1* | 8/2007 | Bakken ..... | F17C 1/08 222/173 |
| 2015/0354756 | A1 | 12/2015 | Philippe et al. | |
| 2017/0175952 | A1 | 6/2017 | Heo | |
| 2017/0276295 | A1 | 9/2017 | Herry et al. | |
| 2017/0320549 | A1 | 11/2017 | Pyo et al. | |

FOREIGN PATENT DOCUMENTS

| | | | |
|---|---|---|---|
| FR | 3001945 | A1 | 8/2014 |
| KR | 101088464 | B1 | 12/2011 |
| KR | 20140032608 | A | 3/2014 |
| KR | 20160034509 | A | 3/2016 |
| WO | WO2008147003 | A1 | 12/2008 |
| WO | WO2013004944 | A1 | 1/2013 |
| WO | WO2014128381 | A1 | 8/2014 |
| WO | WO2016003214 | A1 | 1/2016 |
| WO | WO2016046487 | A1 | 3/2016 |
| WO | WO2016047934 | A1 | 3/2016 |

* cited by examiner

SEALED AND THERMALLY INSULATING TANK

CROSS-REFERENCE TO RELATED APPLICATIONS AND CLAIM TO PRIORITY

This application is a national stage application of International Application No. PCT/FR2016/052648 filed Oct. 13, 2016, which claims priority to French Patent Application No. 1559744 filed Oct. 13, 2015, the disclosures of which are incorporated herein by reference and to which priority is claimed.

FIELD OF THE INVENTION

The invention relates to the field of sealed and thermally insulating tanks with membranes. In particular, the invention relates to the field of sealed and thermally insulating tanks for storing and/or transporting low-temperature liquids, such as tanks for transporting Liquefied Petroleum Gas (also referred to as LPG) at, for example, a temperature of between −50° C. and 0° C., or for transporting Liquefied Natural Gas (LNG) at approximately −162° C. at atmospheric pressure. These tanks may be installed on land or on a floating structure. In the case of a floating structure, the tank may be intended for transporting liquefied gas or for receiving liquefied gas used as a fuel for the propulsion of the floating structure.

BACKGROUND OF THE INVENTION

WO-A-2016046487, for example, describes a wall structure for creating the flat wall of a tank with double sealed membrane. The secondary sealed membrane of such a tank wall experiences high stresses in service, these being associated with the various loadings of the tank, with thermal contraction, with movements of the cargo, and with deformation of the bearing structure in the swell. These stresses are notably transmitted by the thermally insulating barrier to which the secondary sealed membrane is anchored. Because the thermally insulating barrier is made up of large sized discrete insulating panels, the stresses and movements transmitted to the secondary sealed membrane are not distributed uniformly which means that the corrugations in the secondary sealed membrane are stressed differently according to whether they are situated near the edges of the panels or near the center. In addition, the flexibility of certain corrugations is limited by the anchoring of the edges of the metal sheets to the panels. This results in stress concentrations liable to accelerate the aging of the sealed membrane. These problems would also exist if the primary membrane were eliminated.

In WO-A-2016046487, bridging elements arranged between the secondary insulating panels serve to improve the distribution of the movements by limiting the separation movements of the edges of the panels. These bridging elements are able to a certain extent to address the separation movements of the edges of the panels but are limited, complicated to install, and have a relatively high installation cost.

SUMMARY OF THE INVENTION

One idea underlying the invention is that of providing a membrane tank wall structure that addresses at least some of these disadvantages.

According to one embodiment, the invention provides a sealed and thermally insulating tank incorporated into a bearing structure, said tank comprising one or more tank walls borne by one or more bearing walls of the bearing structure, the or each tank wall comprising a thermally insulating barrier fixed to a respective bearing wall of the bearing structure and a sealed membrane borne by said thermally insulating barrier.

The thermally insulating barrier comprises a plurality of rectangular parallelepipedal insulating blocks juxtaposed in a regular rectangular grid pattern, each insulating block comprising an insulating filling and a cover panel facing to the inside of the tank, an upper face of the cover panel on the opposite side to the insulating filling bearing a metallic anchor piece or strip.

The sealed membrane is made up of a corrugated metal membrane comprising a first series of parallel corrugations and flat portions situated between the parallel corrugations and resting on the upper face of the cover panels, the parallel corrugations being arranged parallel to a first direction of the parallelepipedal insulating blocks and spaced by a first corrugations pitch, the sealed membrane comprising for example a plurality of corrugated metal sheets each welded to at least one anchor piece or strip of the thermally insulating barrier.

The pitch of the rectangular grid pattern in a second direction perpendicular to the first direction is equal to twice the first corrugations pitch, which means that the first series of corrugations comprises two corrugations situated in line with each of the insulating blocks, and a flat portion of the sealed membrane situated between the two corrugations is arranged in line with an internal zone of the cover panel that is situated some distance from the edges of the cover panel that are parallel to the first direction, so that the two corrugations of the first series of corrugations are situated in line with a marginal zone of the cover panel which zone is situated between the internal zone and the edges of the cover panel that are parallel to the first direction.

The pitch of the rectangular grid pattern in each direction is substantially equal to a dimension of the insulating blocks in this direction, increased by the width of any gap there might be between insulating blocks. This width of gap may be substantially zero and, in any event, remains very small in size in relation to the insulating block.

The metal anchor piece of each insulating block is arranged at least in the internal zone of the cover panel, the sealed membrane being fixed to the thermally insulating barrier by the fixing of said flat portions of the sealed membrane to said anchor pieces of a plurality of the insulating blocks only in the internal zone of the cover panels.

The sealed membrane is thus fixed to some of the or to each of the insulating blocks by the anchor pieces, but only in the internal zone of the cover panels.

Thanks to these features, each corrugation of the first series, or at least a large proportion of the corrugations of the first series, is in a similar situation as regards its freedom to deform, given that a first flat portion bordering the corrugation is situated on the side of the internal zone of the insulating block and fixed to the anchor piece, whereas the second flat portion bordering the corrugation on the other side straddles the marginal zone of the insulating block, the marginal zone of the adjacent insulating block and the interface between the two insulating blocks, without being fixed to any one of the two insulating blocks. In other words, the flat portions of the sealed membrane are situated alternately on the internal zone of the cover panels and on the interfaces between insulating blocks and adjacent marginal zones. The result of this arrangement is a corrugated and sealed metal membrane in which any corrugation of the first series has one side fixed to the insulating barrier and one side not fixed to the insulating barrier, but in sliding contact with the insulating barrier. This side not fixed to the insulating barrier increases the freedom of the corrugations to deform under the effect of the thermal stresses and of the deformations of the bearing structure, notably the hull of a ship in the swell. As a result, the distribution of stresses and deformations in the corrugated metal membrane is more even in service and the life of the corrugated metal membrane is thereby improved.

According to some embodiments, such a tank may have one or more of the following features.

The extent of the anchor piece can vary, provided that the sealed membrane is fixed only to the internal zone of the cover panel. According to one embodiment, the anchor piece is interrupted some distance from the edges of the cover panel and is confined to the internal zone of the cover panel, and the two corrugations of the first series of corrugations are situated one on each side of the anchor piece of each of the insulating blocks. In other words, the marginal zone of the cover panels here is situated between the anchor piece and the edges of the cover panel. This arrangement makes it possible to save material in the metal anchor piece or anchor strip.

According to one embodiment, there is an offset equal to substantially half the first corrugations pitch between the corrugations parallel to the first direction and the edges of the insulating blocks parallel to the first direction. By virtue of these features, the corrugations parallel to the first direction are arranged equidistantly from the interfaces, and this evens out better still the loads on these corrugations, notably when these loads are the result of a relative movement of the underlying insulating blocks.

The internal zone of the cover panel refers to a zone which lies some distance from the edges of the cover panel and which may be centered or off-centered with respect to these edges. According to one embodiment, the anchor piece is arranged at the center of the cover panel and the two corrugations of the first series of corrugations are situated at equal distances from the center of the cover panel.

The corrugated metal membrane may be made in one or more pieces, depending on the dimensions of the wall and the resulting logistical constraints. For preference, the corrugated metal membrane comprises a plurality of corrugated metal sheets of rectangular shape, each corrugated metal sheet comprising two edges parallel to the first direction and two edges parallel to the second direction, the dimension of a corrugated metal sheet in the second direction being equal to an even integer multiple of the first corrugations pitch, and the two edges of the corrugated metal sheet that are parallel to the first direction are essentially situated in the flat portions of the corrugated metal sheet between the corrugations parallel to the first direction and pass over the anchor pieces of the insulating blocks in the internal zone of the cover panels.

By virtue of these features it is possible to fix the sealed membrane to the anchor pieces at the edges of the sheets, thereby making assembly easier.

According to one embodiment, each corrugated metal sheet of rectangular shape has a border zone lap-welded to the border zone of the adjacent corrugated metal sheets, the border zone of a corrugated metal sheet situated on the top being welded each time to the border zone of an adjacent corrugated metal sheet situated underneath, and, along the edges of the corrugated metal sheet that are parallel to the first direction, the border zone of the corrugated metal sheet situated underneath is welded to the anchor pieces of the insulating blocks in the internal zone of the cover panels.

According to one embodiment, the dimension of a corrugated metal sheet in the second direction is equal to twice the first corrugations pitch. By virtue of these features, one in two of the flat portions of the sealed membrane contains the edge of a rectangular sheet which passes in line with the anchor pieces. It is thus possible, by welding only at the edges of the sheets, to anchor the sealed membrane to the anchor pieces at the level of one in two of the flat portions of the sealed membrane.

The metal anchor piece may exhibit various geometries. Advantageously, the anchor piece comprises a metal strip running parallel to the first direction or to the second direction. By virtue of these features, the geometry of the anchor piece is well suited to providing a relatively extensive area for connection with the edge of a corrugated metal sheet.

According to one embodiment, the metal piece or strip is interrupted some distance from the edges of the cover panel and is confined to the internal zone of the cover panel, two thermal protection strips being arranged on the cover panel in the continuation of the metal piece or strip in the marginal zone of the cover panel between the metal piece or strip and the edges of the cover panel. By virtue of these features, the corrugated metal sheets can be butt-welded entirely in line with the metal pieces or strips and thermal protection strips without subjecting the cover panel to excessive heating, thus making it possible to create the cover panel from wood or some other material exhibiting little heat resistance.

Alternatively, the metal piece or strip may extend over the entire length of the cover panel, including the marginal zones of the cover panel, provided that the sealed membrane is fixed to the metal piece or strip only in the internal zone of the cover panel. In that case, the ends of the metal piece or strip that are situated in the marginal zones are merely another form of thermal protection for the cover panel.

According to one embodiment, the anchor piece comprises a metal strip parallel to the first direction and a metal strip parallel to the second direction which strips form a cross in the internal zone of the cover panel. By virtue of these features, the geometry of the anchor piece is well suited to providing an area for connection with two edges of a corrugated metal sheet in the immediate vicinity of a corner of the corrugated metal sheet.

The teachings given hereinabove with reference to a first series of parallel corrugations may also be implemented, in the same way, with reference to a second series of parallel corrugations running at right angles to the first series of corrugations in order to even out the loads and deformations in both directions of the plane.

According to corresponding embodiments:

the sealed membrane further comprises a second series of parallel corrugations, which are arranged parallel to the second direction of the parallelepipedal insulating blocks and spaced apart by a second corrugations pitch, said flat portions of the sealed membrane being furthermore situated between the corrugations parallel to the second direction, the pitch of the rectangular grid pattern in the first direction, which is substantially equal to a dimension of the insulating blocks in the first direction, is equal to twice the second corrugations pitch, which means that the second series of corrugations comprises two corrugations situated in line with each of the insulating blocks, and the two corrugations of the second series of corrugations are situated in line with a marginal zone of the cover panel which zone is situated between the internal zone and the edges of the cover panel that are parallel to the second direction.

the anchor piece is interrupted some distance from the edges of the cover panel and is confined to the internal zone of the cover panel, and the two corrugations of the second series of corrugations are situated one on each side of the anchor piece of each of the insulating blocks.

there is an offset equal to half the second corrugations pitch between the corrugations parallel to the second direction and the edges of the insulating blocks parallel to the second direction.

the anchor piece is arranged at the center of the cover panel and the two corrugations of the second series of corrugations are situated at equal distances from the center of the cover panel.

the dimension of a corrugated metal sheet in the first direction being equal to an even integer multiple of the second corrugations pitch and the two edges of the corrugated metal sheet that are parallel to the second direction are essentially situated in the flat portions of the corrugated metal sheet between the corrugations parallel to the second direction and pass over the anchor pieces of the insulating blocks in the internal zone of the cover panels.

along the edges of the corrugated metal sheet that are parallel to the second direction, the border zone of the corrugated metal sheet situated underneath is welded to the anchor pieces of the insulating blocks in the internal zone of the cover panels.

the dimension of a corrugated metal sheet in the first direction is equal to twice the second corrugations pitch.

the first corrugations pitch is equal to the second corrugations pitch and the insulating blocks have a square outline.

The insulating blocks may be produced in different ways. According to one embodiment, each parallelepipedal insulating block comprises a box structure in which the insulating filling is housed, said box structure comprising a bottom panel and side panels extending between said bottom panel and the cover panel. According to another embodiment, each parallelepipedal insulating block comprises a bottom panel and a cover panel with an interposed block of foam forming said insulating filling.

According to one embodiment, the sealed membrane of each tank wall comprises:

a first series of corrugations projecting toward the inside of the tank and extending in a first direction, and a second series of corrugations projecting toward the inside of the tank and extending in a second direction perpendicular to the first direction.

The corrugations of the sealed membrane may be formed in different ways. According to some embodiments, the corrugations project toward the inside of the tank with respect to the flat portions, or alternatively the corrugations project toward the outside of the tank with respect to the flat portions and are housed in grooves formed in the cover panels of the insulating blocks.

According to one embodiment, the thermally insulating barrier of the first or second tank wall comprises universal parallelepipedal insulating blocks facing a longitudinal face of edging blocks opposite the edge corner of the tank, an upper face of the cover panel of each of the universal parallelepipedal insulating blocks comprising a step facing a step in the upper face of the cover panel of the corresponding edging block, a connecting sheet housed jointly in said steps lying flush with the level of the upper face of said cover panels so as to form a continuous flat support surface for the sealed membrane of the first or second tank wall. By virtue of this feature it is possible to adjust a distance between the row of edging blocks and the first row of universal blocks without generating spaces in the support of the sealed membrane.

According to one embodiment, the spaces between each edging block of the first and/or second row and the adjacent parallelepipedal insulating blocks and spaces between said edging blocks and the first bearing wall contain an intermediary insulating filling.

According to one embodiment, the corrugated metal sheets have a rectangular shape, each parallelepipedal insulating block comprising two secant anchor strips, each anchor strip running parallel to a respective side of the corrugated metal sheets fixed to said anchor strips.

According to one embodiment, the thermally insulating barrier is a secondary thermally insulating barrier and the sealed membrane is a secondary sealed membrane, the tank wall further comprising a primary thermally insulating barrier arranged on the secondary sealed membrane and a primary sealed membrane borne by said primary thermally insulating barrier.

For preference in this case, the metal anchor pieces of the insulating blocks of the secondary thermally insulating barrier bear primary retaining members, for example threaded studs or bushings, and the primary thermally insulating barrier comprises a plurality of juxtaposed rectangular parallelepipedal insulating blocks anchored to the primary retaining members.

According to one embodiment, the secondary sealed membrane comprises cutouts to allow the primary retaining members to project above the secondary sealed membrane, and edges of the cutouts in the secondary sealed membrane are welded in a sealed manner to the metal anchor pieces of the insulating blocks of the secondary thermally insulating barrier all around the primary retaining members. For preference, these cutouts are made on the edges of the rectangular sheets, but they can also be produced in a flat portion situated within a rectangular sheet.

Such a tank may form part of a land storage facility, for example for storing liquefied gas, or may be installed in an inshore, or offshore floating structure, notably a methane tanker, an LPG tanker, a floating storage and regasification unit (FSRU), a floating production storage and offloading (FPSO) unit or the like.

According to one embodiment, a ship for transporting a cold liquid product comprises a hull and an aforementioned tank arranged inside the hull.

According to one embodiment, the invention also provides a method for loading or unloading such a ship, in which method a cold liquid product is conveyed through insulated pipes from or to a floating or land storage facility to or from the tank of the ship.

According to one embodiment, the invention also provides a transfer system for a cold liquid product, the system comprising the aforementioned ship, insulated pipes are arranged in such a way as to connect the tank installed in the hull of the ship to a floating or land storage facility and a pump for causing a cold liquid product to flow through the insulated pipes from or to the floating or land storage facility to or from the tank of the ship.

BRIEF DESCRIPTION OF THE DRAWINGS

The invention will be better understood and further objects, details, features and advantages thereof will become more clearly apparent during the course of the following description of a number of particular embodiments of the invention which are given solely by way of nonlimiting illustration with reference to the attached drawings.

DETAILED DESCRIPTION OF THE PREFERRED EMBODIMENT(S)

Figure 1:
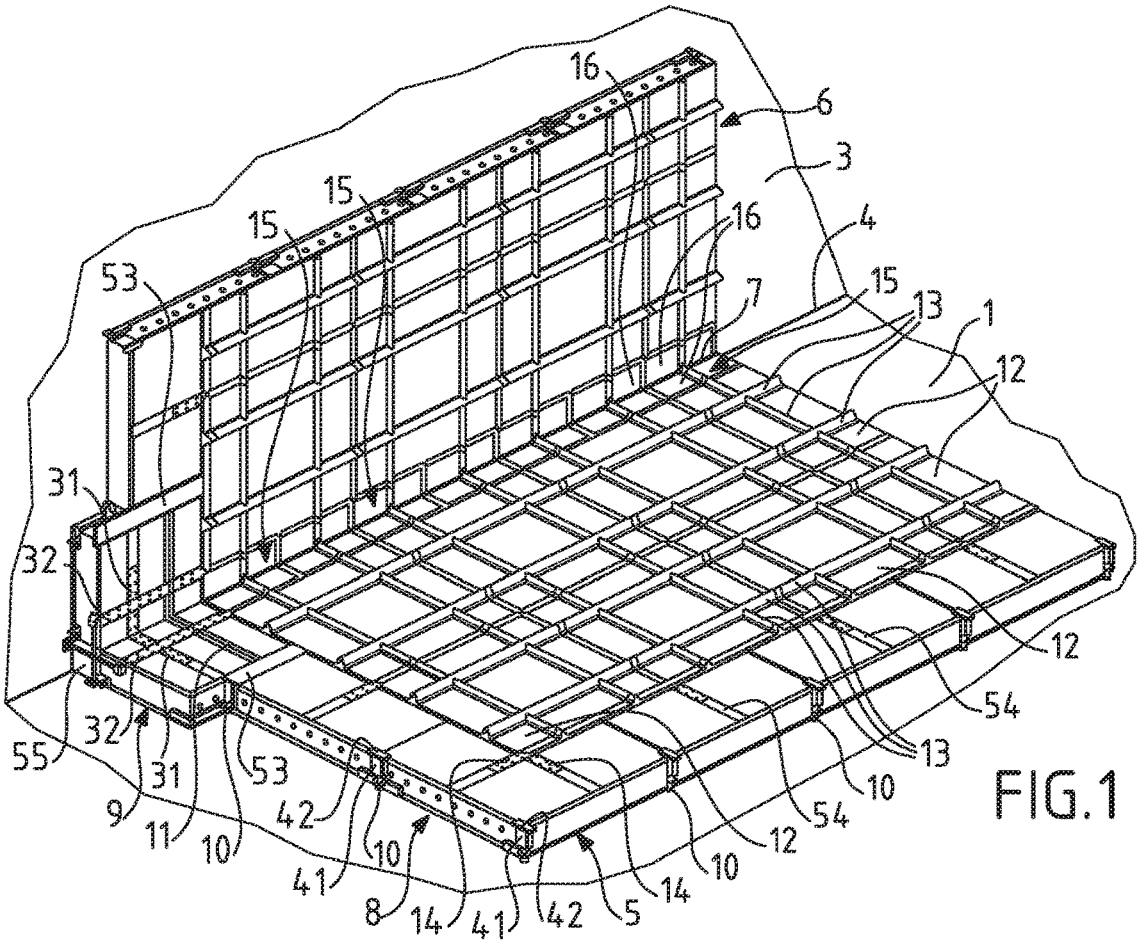
FIG. 1 is a perspective view of a portion of tank for transporting and/or storing liquefied gas, illustrating an edge corner of the tank formed by a longitudinal wall of the tank and a transverse wall of the tank, the transverse wall of the tank making with the longitudinal wall of the tank an angle of the order of 90°.

The figures are described hereinbelow in the context of a bearing structure consisting of the internal walls of a double hull of a ship for transporting liquefied gas. Such a bearing structure has a polyhedral geometry, for example of prismatic shape. In such a bearing structure, longitudinal walls 1 of the bearing structure run parallel to the longitudinal direction of the ship and form a polygonal section in a plane perpendicular to the longitudinal direction of the ship. The longitudinal walls 1 meet at longitudinal edge corners 2 which form, for example, angles of the order of 135° in an octagonal geometry. The overall structure of such polyhedral tanks is for example described with reference to FIG. 1 of document FR-A-3008765.

The longitudinal walls 1 are interrupted in the longitudinal direction of the ship by transverse bearing walls 3 which are perpendicular to the longitudinal direction of the ship. The longitudinal walls 1 and the transverse walls 3 meet at front and rear edge corners 4.

Each wall 1, 3 of the bearing structure bears a respective tank wall. According to a first embodiment, each of the tank walls is made up of a single thermally insulating barrier bearing a single sealed membrane in contact with a fluid stored in the tank, such as liquefied petroleum gas containing butane, propane, propene or the like and having an equilibrium temperature of between −50° C. and 0° C.

By convention, the adjective "upper" applied to an element of the tank refers to that part of this element that is oriented toward the inside of the tank and the adjective "lower" refers to that part of this element that is oriented toward the outside of the tank, regardless of the orientation of the tank wall with respect to the Earth's gravitational field. Likewise, the term "above" refers to a position situated further toward the inside of the tank and the term "underneath" refers to a position situated further toward the bearing structure, regardless of the orientation of the tank wall with respect to the Earth's gravitational field.

FIG. 1 illustrates a tank corner in the region of the front or rear edge corner 4 between one of the longitudinal walls 1 and one of the transverse walls 3 of the bearing structure respectively bearing a longitudinal tank wall 5 and a transverse tank wall 6. The longitudinal tank wall 5 and the transverse tank wall 6 meet at a corner structure 7 of the tank forming an angle of the order of 90°. Because the longitudinal tank wall 5 and the transverse tank wall 6 have a similar structure, only the longitudinal tank wall 5 is described hereinafter. The description of the longitudinal tank wall 5 applies correspondingly to the transverse tank wall 6.

The thermally insulating barrier of the longitudinal tank wall 5 is made up of a plurality of insulating elements anchored along the entire longitudinal bearing wall 1. These insulating elements together form a flat surface to which the sealed membrane of the longitudinal tank wall 5 is anchored. These insulating elements more particularly comprise a plurality of universal insulating elements 8 juxtaposed in a regular rectangular grid pattern. The thermally insulating barrier of the longitudinal tank wall 5 also comprises a row of edging insulating elements 9 described hereinafter with reference to FIG. 2, arranged along the edge corner 4. The insulating elements 8, 9 are anchored to the bearing structure by any suitable means, such as, for example, using anchor members 10 such as described with reference to FIG. 3. The insulating elements 8, 9 rest on the longitudinal bearing wall via beads of mastic (not illustrated) forming straight or wavy parallel lines. An intermediary space 11 separates the edging insulating elements facing one another of the row of edging insulating elements 9. The intermediary spaces 11 of two tank walls 5 and 6 that form an edge corner of the tank are aligned.

The sealed membrane of the longitudinal tank wall 5 is made up of a plurality of metal sheets 12 juxtaposed with one another with overlap. These metal sheets 12 are preferably rectangular in shape. The metal sheets 12 are welded together in order to seal the sealed membrane. For preference, the metal sheets 12 are made of stainless steel, for example with a thickness of 1.2 mm.

In order to allow the sealed membrane to deform in response to the various stresses experienced by the tank, in particular in response to the thermal contraction resulting from the loading of liquefied gas into the tank, the metal sheets 12 have a plurality of corrugations 13 oriented toward the inside of the tank. More particularly, the sealed membrane of the longitudinal tank wall 5 comprises a first series of corrugations 13 and a second series of corrugations 13 forming a regular rectangular pattern. As illustrated in FIG. 1, the first series of corrugations 13 is parallel to the edge corner 4 and the second series of corrugations 13 is perpendicular to the edge corner 4. For preference, the corrugations 13 extend parallel to the edges of the rectangular metal sheets. The distance between two successive corrugations 13 of one series of corrugations is, for example, of the order of 600 mm.

In order to ensure the continuity of the insulating barrier 2 at the region of the corner structure 7, metal corner sheets 15 are welded and arranged on the perpendicular edging insulating elements 9. These metal corner sheets 15 comprise two flat portions 16 situated in the planes of the sealed membrane of each tank wall 5 and 6 respectively.

Figure 2:
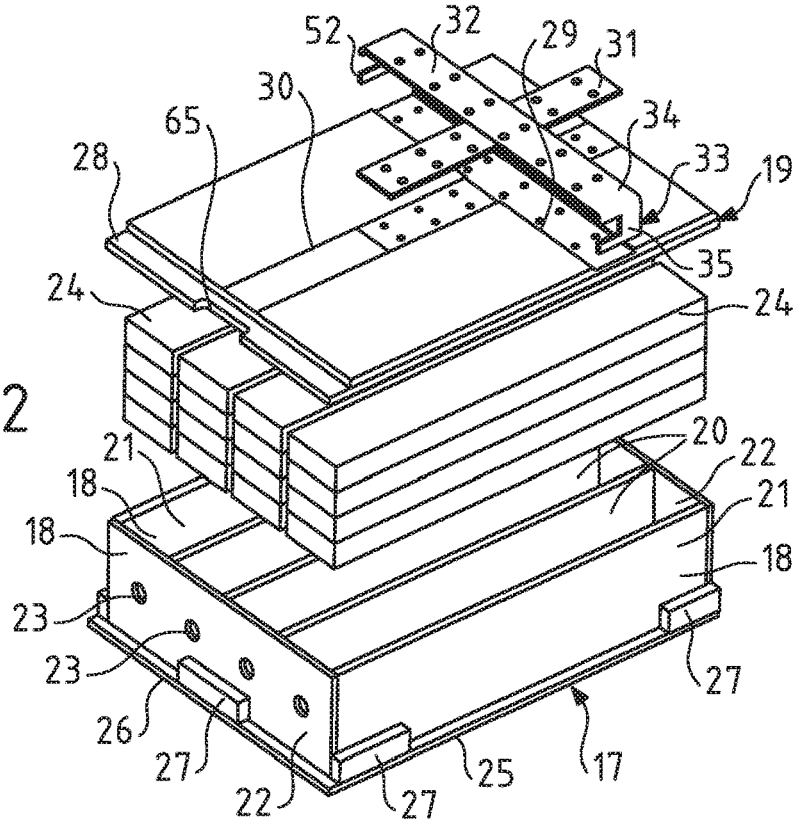
FIG. 2 is an exploded detailed view illustrating an edging thermally insulating box structure of the thermally insulating barrier of a tank wall of FIG. 1.

FIG. 2 depicts an exploded perspective view of an edging insulating element 9 of FIG. 1.

The edging insulating element 9 comprises a bottom panel 17, side panels 18 and a cover panel 19. All of these panels 17, 18, 19 are rectangular in shape and delimit an internal space of the edging insulating element 9. The bottom panel 17 and the cover panel 19 extend parallel to one another and, as illustrated in FIG. 1, parallel to the bearing wall. The side panels 18 extend at right angles to the bottom panel 17. The side panels 18 connect the bottom panel 17 and the cover panel 19 over the entire periphery of the edging insulating element 9. Bearing spacers 20 are arranged between the bottom panel 17 and the cover panel 19 in the internal space of the edging insulating element 9. These bearing spacers 20 extend parallel to longitudinal side panels 21. Transverse side panels 22 extending at right angles to the longitudinal side panels 21 comprise through-orifices 23. These through-orifices 23 are intended to allow the circulation of inert gas in the thermally insulating barrier. The panels and the bearing spacers are attached by any appropriate means, for example screws, staples or nails, and together form a box structure in which an insulating filling 24 is arranged. This insulating filling 24 is preferably non-structural, for example perlite or glass wool.

The bottom panel 17 comprises longitudinal flanges 25 projecting from the longitudinal side panels 21. The bottom panel 17 also comprises a transverse flange 26 projecting from one of the transverse side panels 22. The flanges 25, 26 of the bottom panel 17 bear cleats 27. In the example illustrated in FIG. 2, each end of the longitudinal flanges 25 bears a respective cleat 27 and a central portion of the transverse flange 26 bears a cleat 27. In an alternative form illustrated in FIG. 3, the cleat 27 borne by the transverse flange 26 extends over the entire width of the edging insulating element 9.

The cover panel 19 comprises, on an upper face facing away from the insulating filling 24, a transverse step 28. This transverse step 28 is situated in line with the transverse side panel 22 from which the transverse flange 26 of the bottom panel 17 projects. This transverse step 28 comprises a notch 65 situated in line with the cleat 27 borne by the transverse flange 26. There are numerous methods that can be used to create the cover panel 19. In the embodiment illustrated in FIG. 2, two sheets of plywood of different dimensions are superposed in such a way as to form the cover panel 19 exhibiting the transverse step 28. In an embodiment which has not been illustrated, the cover panel is made of a sheet of plywood in which a milling has been created in order to form the transverse step.

The upper face of the cover panel 19 further comprises a transverse milling 29 and a longitudinal milling 30. The transverse milling 29 extends in a direction parallel to the width of the cover panel 19 over the entire width of the cover panel 19. The transverse milling 29 is situated close to the opposite transverse side of the cover panel 19 from the transverse flange 26. The longitudinal milling 30 extends in a direction parallel to the length of the cover panel 19 over the entire length of the cover panel 19. For preference, this longitudinal milling 30 is centered on the width of the cover panel 19. In the embodiment illustrated in FIG. 2, the longitudinal milling 30 is situated in the continuation of the notch 65.

A longitudinal anchor strip 31, which constitutes a metal anchor piece, is housed in the longitudinal milling 30. This longitudinal anchor strip 31 has a length shorter than the length of the cover panel 19. A thermal protection 54 (illustrated in FIG. 3) is housed in that portion of the longitudinal milling 30 that does not contain the longitudinal anchor strip 31.

Likewise, a transverse anchor strip 32, which constitutes a metal anchor piece, is housed in the transverse milling 29 of the cover panel 19. However, this transverse anchor strip 32 extends over the entire width of the cover panel 19. Each end of the transverse anchor strip 32 comprises a tab 33. This tab 33 projects from a respective longitudinal side of the cover panel 19.

In a similar way to the edging insulating elements 9, each universal insulating element 8 comprises on an upper face two perpendicular anchor strips 14, which constitute metal anchor pieces, housed in respective millings and screwed or riveted to the cover panels. The anchor strips 14 are preferably arranged parallel to the corrugations 13. The anchor strips 14 extend over a central portion of the millings in which they are housed. Thermal protections 54 are housed in the ends of the millings.

The metal sheets 12, 15 of the sealed membrane are welded to the anchor strips 14, 31, 32 on which they rest. The thermal protections 54 avoid damage to the insulating elements 8, 9 when the metal sheets 12, 15 are being welded together along their edges. The thermal protections 54 are made of heat-resistant material, for example a glass fiber-based composite material. Welding the metal sheets 12, 15 to the anchor strips 14, 31, 32 allows the sealed membrane to be held against the insulating barrier but causes tensile loads to be transmitted by the metal sheets 12, 15 to the anchor strips 14, 31, 32 to which they are welded.

The tab 33 comprises a spacing portion 34 extending from the cover panel 19 in the continuation of the transverse milling 29. This tab further comprises a coupling portion 35 extending from an opposite end of the spacing portion 34 to the cover panel 19. The coupling portion 35 extends in the direction of the bottom panel 17. The coupling portion 35 comprises a slot 52 facing toward the transverse side of the cover panel 19 that exhibits the step 65.

The anchor strips 31, 32 are fixed to the cover panel 19 by any suitable means, for example by riveting. The transverse anchor strip 32 is fixed in such a way as to exhibit clearance in a longitudinal direction of the cover panel 19, for example of the order of one to a few tenths of a millimeter. Typically, in the case of fixing by riveting, the orifices (not illustrated) in the cover panel 19 through which the rivets that fix the transverse anchor strip 32 pass have a longitudinal dimension that exceeds the thickness of the rivet. Likewise, the transverse anchor strip 32 is housed in the transverse milling 29 with clearance. Such clearances allow for the transmission of tensile forces generated in the longitudinal direction of the cover panel 19 by the sealed membrane welded to the anchor strips 31, 32 without these forces being substantially transmitted to the cover panel 19.

Figure 3:
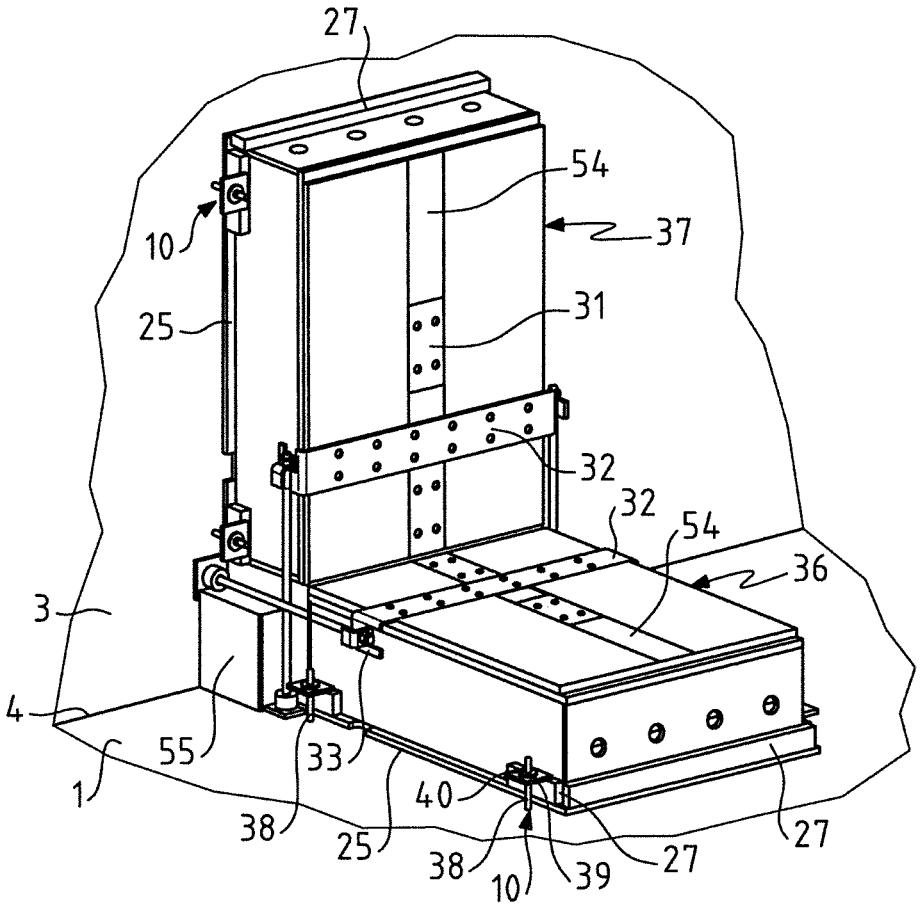
FIG. 3 is a detailed view illustrating two edging thermally insulating box structures of FIG. 1, these two box structures together forming a portion of the edge corner of the thermally insulating barrier of the tank of FIG. 1.

FIG. 3 is a detailed view illustrating a longitudinal edging insulating element 36 and a transverse edging insulating element 37 belonging to the longitudinal tank wall 5 and the transverse tank wall 6. The longitudinal edging insulating element 36 and the transverse edging insulating element 37 together form the corner structure 7. The transverse edge of the longitudinal edging insulating element 36 that does not have the step 65 and the transverse edge of the transverse edging insulating element 37 that does not have the step 65 are butted together. Because the longitudinal edging insulating element 36 has a structure similar to the structure of the transverse edging insulating element 37, only the longitudinal edging element 36 illustrated in FIG. 3 is described hereinbelow. The description of this longitudinal edging insulating element 36 can be applied by analogy to the transverse edging insulating element 37.

The anchor members 10 illustrated in FIG. 3 each comprise a stud 38 welded to the longitudinal bearing wall 1. Each stud 38 extends at right angles to the longitudinal bearing wall 1. An opposite end of the studs to the longitudinal bearing wall 1 has a screw thread. A bearing plate 39 of square shape comprises a central orifice (not illustrated) through which the stud 38 passes. A nut 40 is mounted on the threaded end of the stud 38. The bearing plate 39 of each stud 38 is thus kept pressed by said nut 40 against an upper face of a respective cleat 27 borne by a corresponding flange 25, 26 of the bottom panel 17. In an alternative form that has not been illustrated, the bearing plate rests directly on the flange of the bottom panel of the insulating element.

As illustrated in FIG. 1, such anchor members 10 are also positioned at the corners of each universal insulating element 8. The lateral walls of each universal insulating element 8 have a flange. A cleat 27 is positioned on each of the ends of said flange. Each cleat 27 of the universal insulating elements 8 collaborates with a respective anchor member 10, one same bearing member 10 collaborating with the cleats 27 of a plurality of adjacent universal insulating elements 8. The corners of the adjacent universal insulating elements 8 comprise a cutout which together form a shaft in line with a corresponding fixing member 10. This shaft allows the nut 40 to be screwed onto the stud of the fixing member 10. This shaft is filled with an insulating filling 41 and covered with a blanking plate 42 so as to form a flat surface with the cover panels of the insulating elements.

In the embodiment illustrated in FIG. 1, each universal insulating element 8 has a width, measured parallel to the edge corner 4, that is twice the width of the edging insulating elements 9. The universal insulating elements 8 and the edging insulating elements 9 are arranged in such a way that the corners of two adjacent universal insulating elements 8 are situated mid-way across the width of an edging insulating element 9 in line with the transverse flange 26 of a respective edging insulating element 9. The anchor member 10 associated with said corners of the universal insulating elements 8 thus collaborates both with the cleats 27 of said universal insulating elements 8 and with the cleat 27 borne by the transverse flange 26. The notch 65 in the edging insulating element 9 allows passage for the tooling needed to tighten the nut of said anchor member 10.

In an embodiment which has not been illustrated, the universal insulating elements and the edging insulating elements have the same width but are offset from one another in a direction parallel to the edge corner. Thus, the corners of two adjacent universal insulating elements are situated mid-way across the width of an edging insulating element and in line with the transverse flange of said edging insulating element.

Moreover, the universal insulating elements 8 situated facing the edging insulating elements 9 comprise a step similar to the step 28 of said edging insulating element 9 facing said step 28 of the edging insulating element 9. Cover strips 53 are housed jointly in the steps of the universal insulating elements 8 and of the edging insulating elements 9 opposite so as to cover a space between said insulating elements 8 and 9. This space is filled with insulating filling such as, for example, glass wool. Such cover strips lie flush at the level of the upper face of the cover panels of the insulating elements 8 and 9 so as to offer a continuous flat surface for the sealed membrane. Moreover, such cover strips 53 make it possible to compensate for construction clearances that may arise during the building of the tank.

Furthermore, the spaces 55 situated between the edging insulating elements 9 and the bearing walls 1 and 3 facing each other are advantageously filled with insulating filling such as glass wool.

Figure 4A:
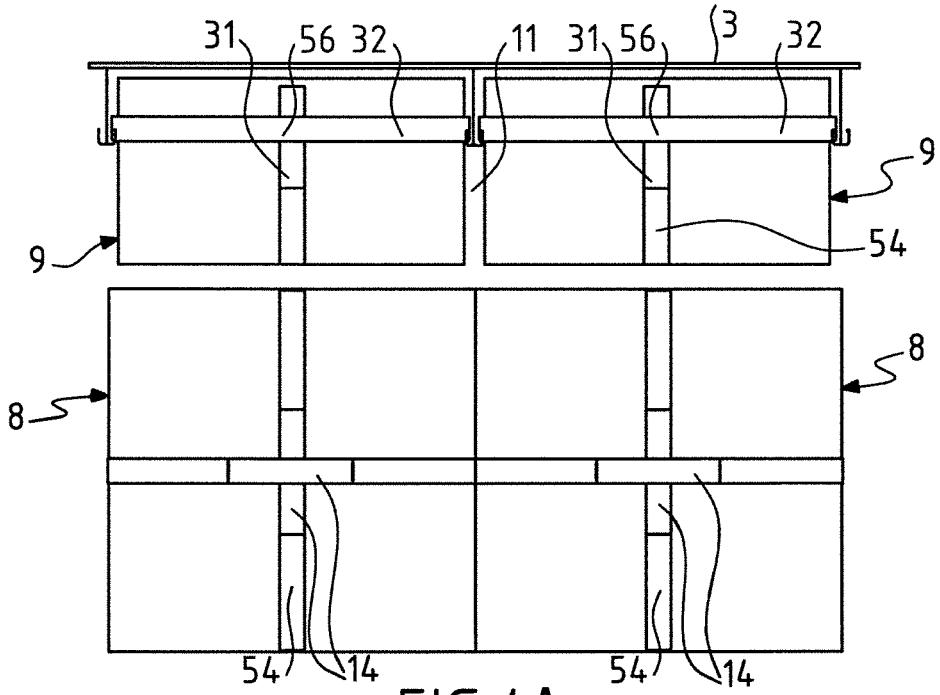
FIG. 4A is a schematic plan view of a tank wall in the region of the 90° edge corner, illustrating an alternative form of embodiment of the edging insulating elements.

FIG. 4A is a schematic plan view of a tank wall in the region of an edge corner according to an alternative form of embodiment. The same reference numerals are used for elements that exhibit the same structure and/or offer the same function.

In the alternative form illustrated in FIG. 4A, the edging insulating elements 9 have a width similar to the width of the universal insulating elements 8. The width of the universal insulating elements 8 is, for example, approximately 1200 mm, and the width of the edging insulating elements 9 of the order of 1160 mm. In this alternative form, the corrugations (not illustrated) of the metal sheets (not illustrated) are not positioned in line with the intermediary spaces 111 but on the cover panels 19 of the edging insulating elements 9. Furthermore, the metal sheets (not illustrated) are welded to the anchor strips 32 discontinuously and only at the level of a central portion 56 of the anchor strip 32. This discontinuous welding of the metal sheets allows the corrugations to be left free to work in extension in order to absorb deformations of the sealed membrane. The edging insulating elements 9 are centered on the universal insulating elements 8. Likewise, the anchor strips 14 and 31 are arranged coaxially in a direction perpendicular to the edge corner.

Figure 5:
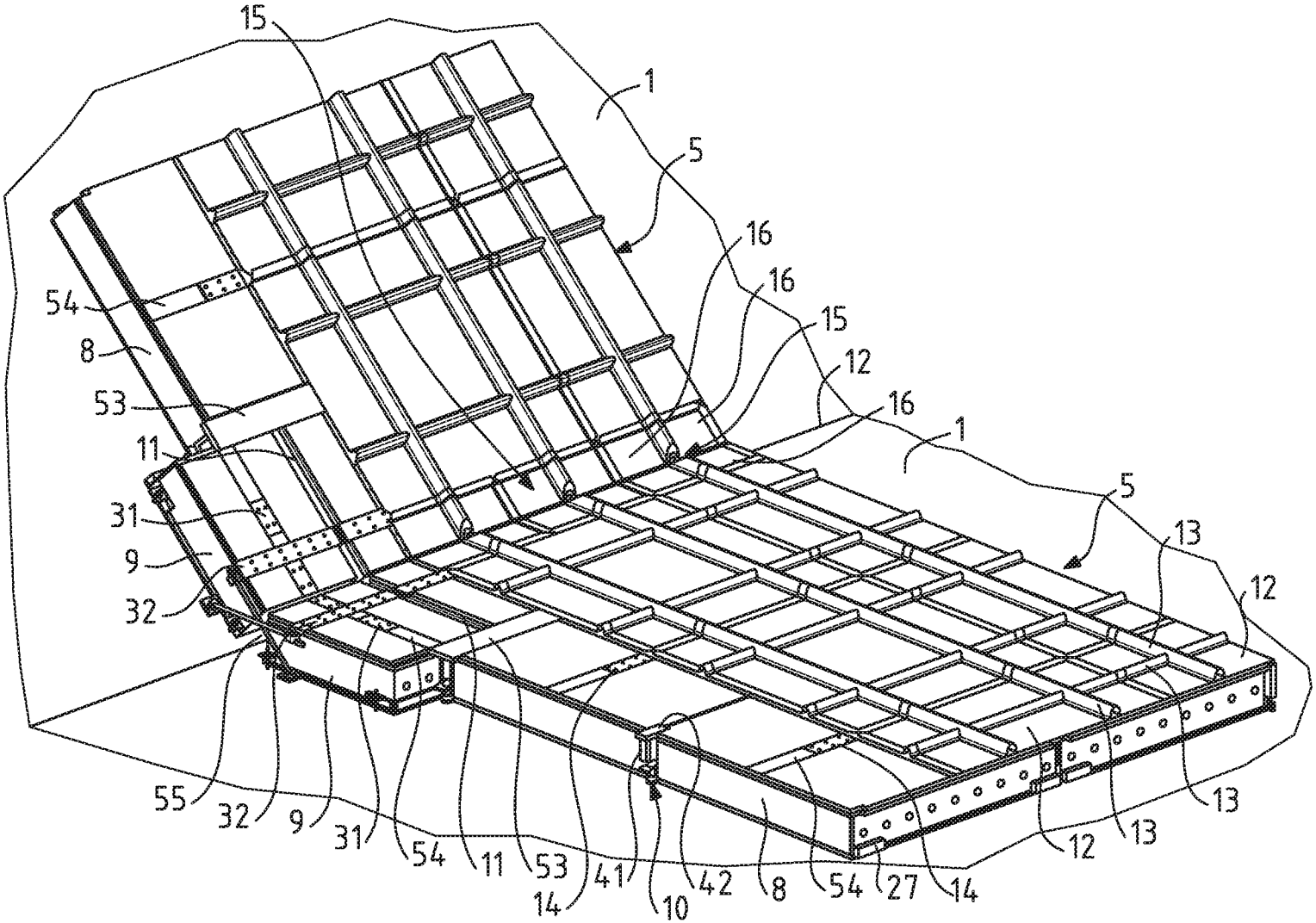
FIG. 5 is a perspective view of another portion of tank for transporting and/or storing liquefied gas, illustrating an edge corner of the tank formed between two longitudinal tank walls making an angle of 135°.

FIG. 5 depicts a tank edge corner between two longitudinal tank walls 5 forming an angle of the order of 135°. Such a tank edge corner exhibits a structure similar to the tank corner structure 7 forming an angle of 90°, as described with reference to FIGS. 1 to 3. The same reference numerals are used for elements that exhibit the same structure and/or offer the same function.

A flat wall of the tank will now be described in greater detail with reference to FIGS. 6 to 8. In this regard it is convenient to note that the flat wall is produced according to a periodic pattern in both directions of the plane, which pattern can therefore be repeated over expanses of greater or lesser magnitude according to the dimensions of the surfaces that are to be covered. As a result, the number of universal insulating elements 8 shown in the figures is nonlimiting and can be modified in one direction or the other as required according to the geometry of the bearing structure. In addition, over a flat wall of large expanse, there may locally be one or more individual zones in which the grid pattern has to be modified in order to negotiate an obstacle or accommodate particular equipment.

Over the flat portion of the bearing wall 1 or 3, the thermally insulating barrier is essentially made up of universal insulating elements 8 juxtaposed according to the regular rectangular grid pattern. A sample of this grid pattern comprising two rows each of four universal insulating elements 8 is shown in FIG. 6 for illustrative purposes.

The edges of the universal insulating elements 8 and the edges of the metal sheets 12 are parallel to the two directions defined by the corrugations 13. Because the corrugations pitch of the sealed membrane is the same in the two directions defined by the corrugations 13, the universal insulating elements 8 have a shape with a square outline. Specifically, the dimension of the universal insulating elements 8 is equal to twice the corrugations pitch in each of the two directions. If the corrugations pitches were different in the two directions, the outline would be rectangular.

In the center of the cover panel of each universal insulating element 8 there are the two anchor strips 14 arranged in the shape of a cross and with their branches also parallel to the two directions defined by the corrugations 13 so as to correspond to the edges of the metal sheets 12.

Figure 4B:
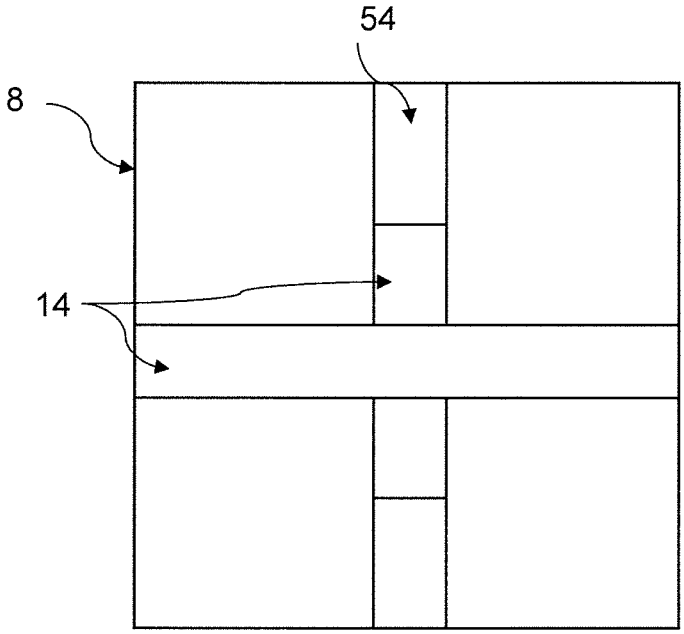
FIG. 4B is a schematic plan view of an insulating element.

In an alternative embodiment shown in FIG. 4B, one of the anchor strips 14 extends over the entire length of the insulation element 8.

Figure 6:
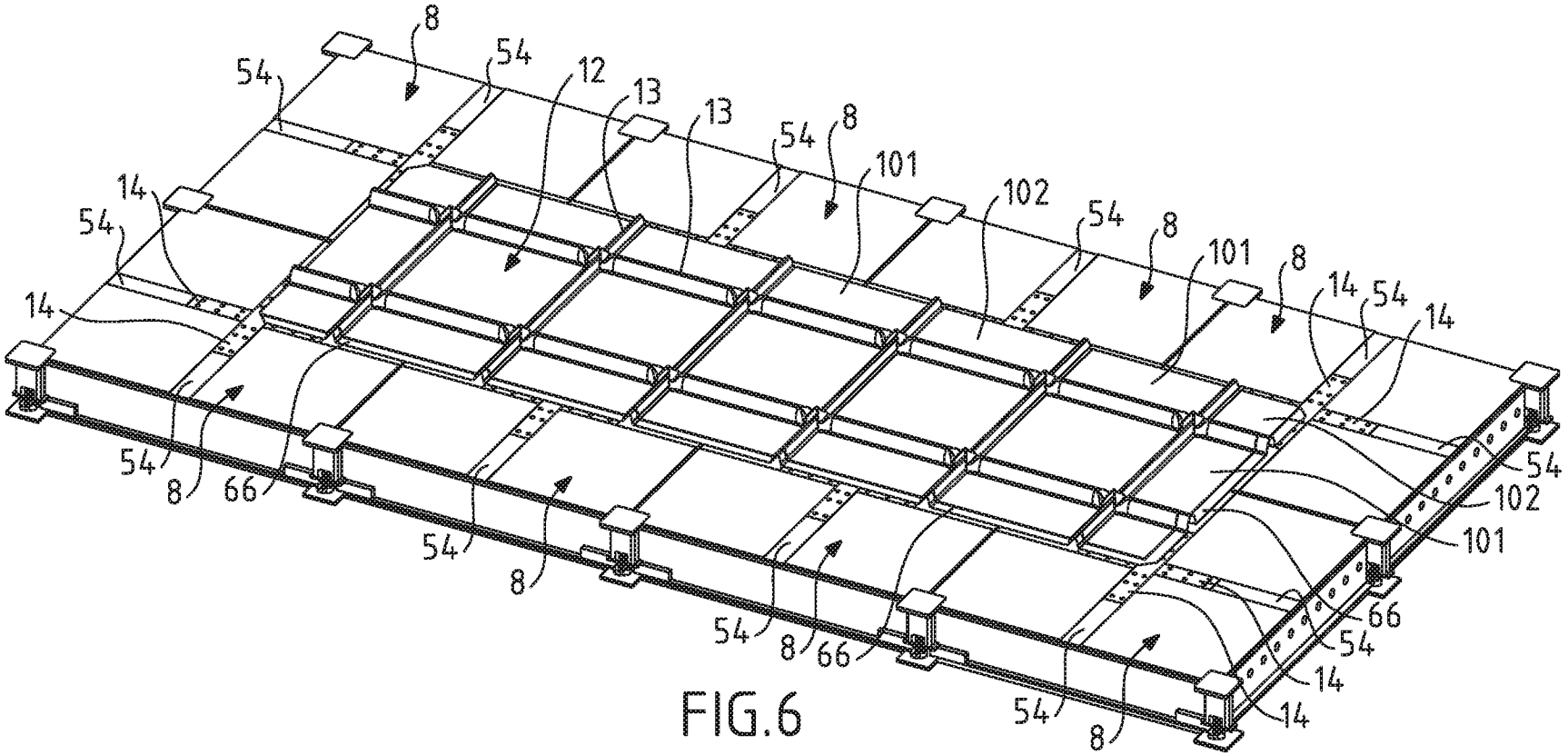
FIG. 6 is a perspective view of another portion of tank for transporting and/or storing liquefied gas, illustrating a flat tank wall according to a first embodiment.
Figure 7:
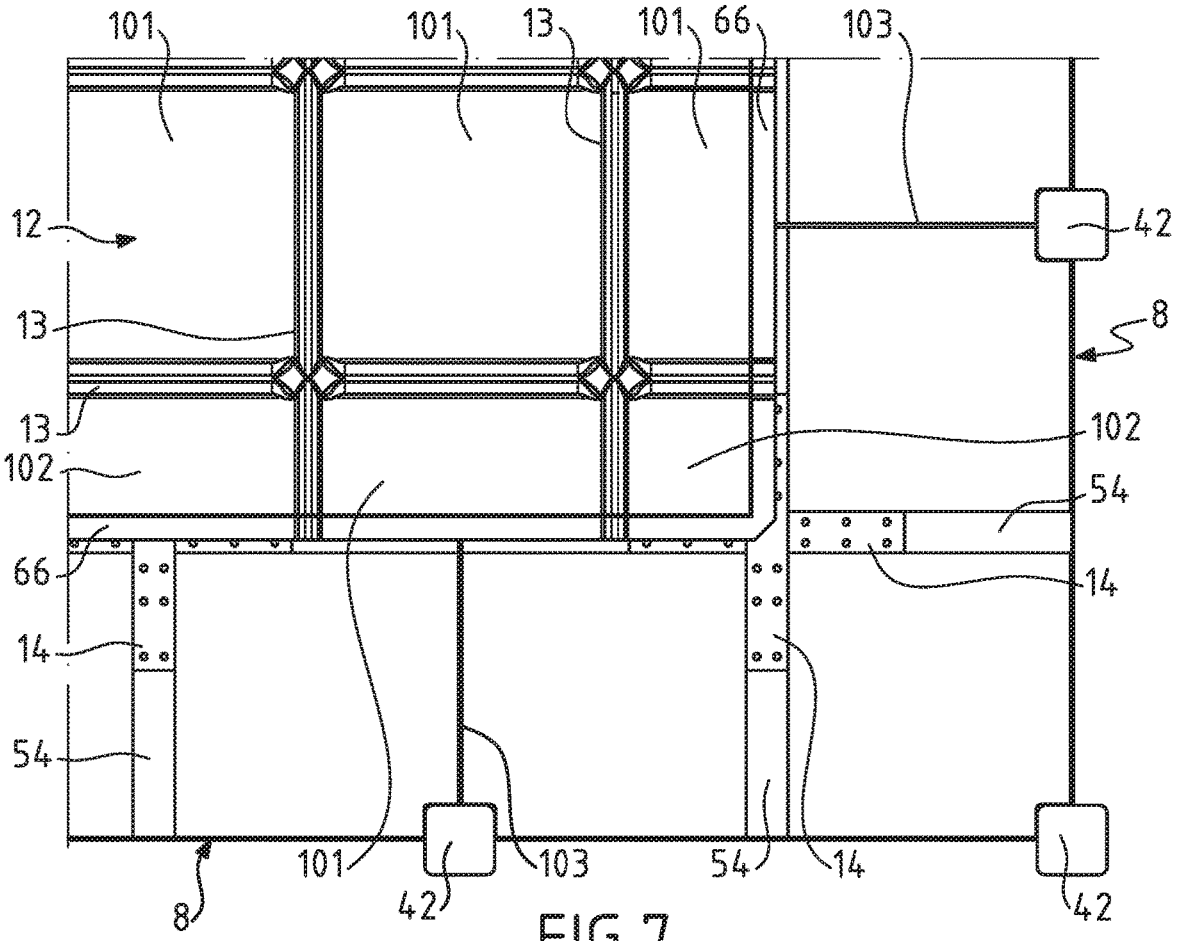
FIG. 7 is an enlarged plan view of a detail of the flat wall of FIG. 6.

As can best be seen in FIG. 7, because the anchor strips 14 are confined to a central zone of the cover panel away from the edges of the universal insulating elements 8 and because the corrugations extend into marginal zones of the cover panel situated between the anchor strips 14 and the edges of the universal insulating elements 8, each corrugation 13 is arranged between a flat portion 101 which is not fixed to the thermally insulating barrier and which straddles an interface 103 between the universal insulating elements 8 and at maximum one flat portion 102 which is fixed to the thermally insulating barrier by welding to the anchor strips 14. In other words, as best visible in FIG. 6, each of the corrugations 13 is arranged between, on the one side, flat portions (also referred to herein as first flat portions) which are fixed to the thermally insulating barrier at the rate of one corrugations pitch in two (namely the portions 102) and, on the other side, flat portions (also referred to herein as second flat portions, namely the portions 101) which are free to slide over the universal insulating elements 8. This property can be maintained over a portion or the entirety of the length of the tank wall and/or a portion or the entirety of the width of the tank wall by repeating the pattern. This results in an evening-out of the deformations transmitted to the various corrugations 13.

Figure 8:
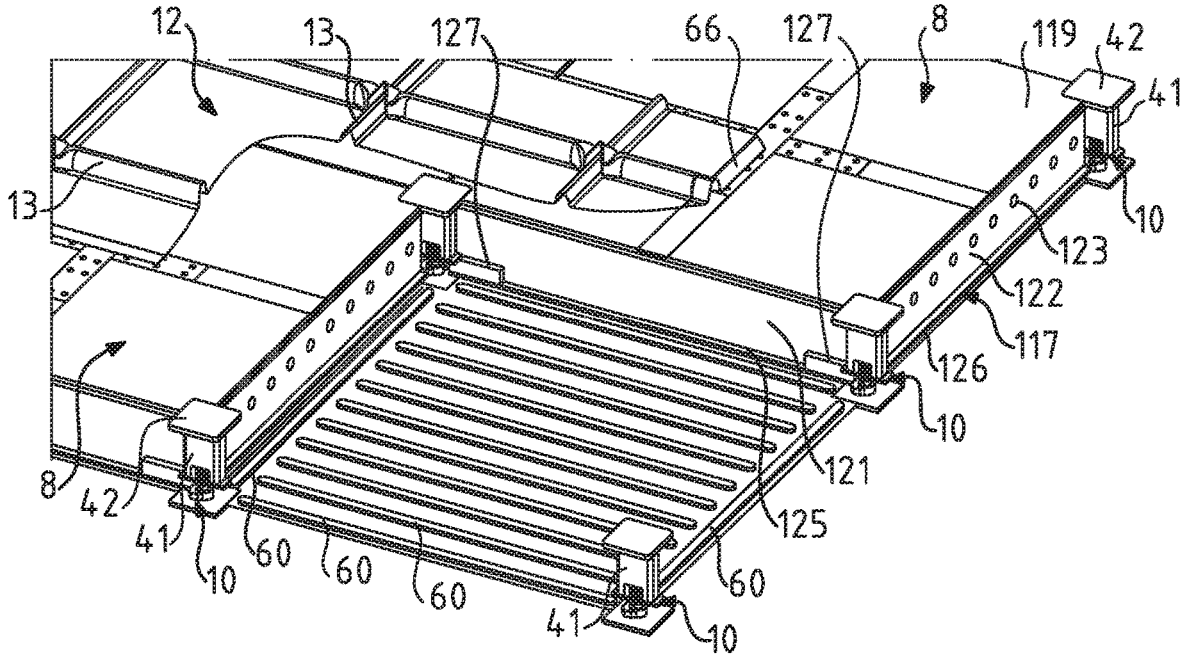
FIG. 8 is an enlarged view of a detail of the flat wall of FIG. 6, in perspective with cutaway.

FIG. 8 shows that the overall structure of the universal insulating element 8 is, apart from the dimensional differences and the anchor strips 14, very similar to that of the edging insulating element 9. The universal insulating element 8 thus comprises a bottom panel 117, two longitudinal side panels 121, two transverse side panels 122, and a cover panel 119. All of these panels are rectangular in shape and delimit an internal space of the insulating element. The bottom panel 117 and the cover panel 119 extend parallel to one another and parallel to the bearing wall. The side panels 121, 122 extend at right angles to the bottom panel 117 and connect the bottom panel 117 and the cover panel 119 over the entire periphery of the insulating element. Bearing spacers, not depicted, are arranged between the bottom panel 117 and the cover panel 119 in the internal space of the insulating element, parallel to the longitudinal side panels 121. The transverse side panels 122 extending at right angles to the longitudinal side panels 121 comprise through-orifices 123. These through-orifices 123 are intended to allow the circulation of inert gas in the thermally insulating barrier. The panels and the bearing spacers are attached by any appropriate means, for example screws, staples or nails, and together form a box structure in which an insulating filling, not depicted, is arranged. This insulating filling is preferably non-structural, for example perlite or glass wool or low-density polymer foam, for example with a density of the order of 10 to 30 $kg/m^{-3}$.

The bottom panel 117 comprises longitudinal flanges 125 projecting from the longitudinal side panels 121 and transverse flanges 126 projecting from the transverse side panels 122. The longitudinal flanges 125 bear cleats 127 at the corners of the universal insulating element 8 to collaborate with the anchor members 10.

FIG. 8 also shows the beads of mastic 60 on which a universal insulating element 8 rests. These beads of mastic 60 are preferably non-stick in order to allow the universal insulating element 8 the freedom to slide with respect to the bearing wall. The anchorage of the universal insulating elements 8 to the bearing wall is achieved in each instance using four anchor members 10 arranged at the four corners, in which an anchor member 10 in each instance collaborates with four adjacent universal insulating elements 8.

Dimensioned Example

In one exemplary embodiment, the dimensions of the universal insulating element 8 are: thickness 220 mm, width 1200 mm, length 1200 mm, for a corrugations pitch of 600 mm in both directions. The width of the gap between the universal insulating elements 8 is negligible here. The corrugations pitch is defined here as being the distance between the top edge corners of two parallel and adjacent corrugations 13. The thickness can be modified according to the requirements in terms of the thermal performance of the tank. The corrugations pitch can be modified according to the requirements in terms of the flexibility of the sealed membrane, which involves modifying the dimension of the universal insulating element 8 accordingly.

In FIG. 6, the single metal sheet 12 depicted has dimensions of two corrugations pitches by six corrugations pitches. The metal sheets 12 that form the sealed membrane may, however, be dimensioned in different ways, provided the dimensioning corresponds to an even integer number of the congregations pitch in each of the two directions of the plane. Thus, the corners of the sheets and the edges of the metal sheets 12 are all situated in line with the anchor strips 14 of the universal insulating elements 8 which support the metal sheet 12. For preference, the dimension of the metal sheet 12 is equal to two corrugations pitches in at least one direction of the plane so that all that is required is welding along the anchor strips 14 situated along the contour of the metal sheet 12 in order to obtain the desired anchoring, ensuring that one and only one edge of each corrugation is fixed to the insulating barrier.

Alternatively, it is possible to produce the sealed membrane using metal sheets 12 that are larger than two corrugations pitches in the two directions of the plane, provided that additional welds are performed to weld the flat portions situated away from the edges of the metal sheet to the underlying anchor strips 14.

Figure 9:
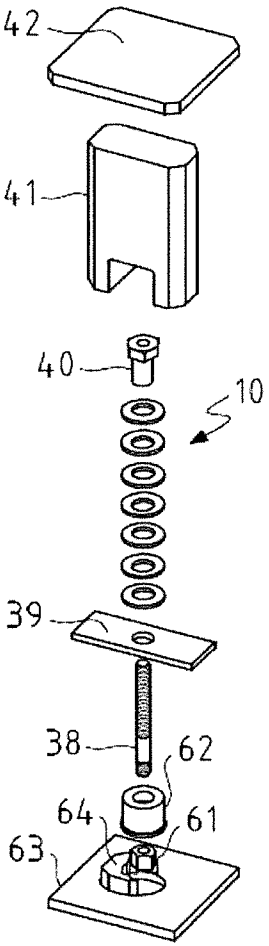
FIG. 9 is an exploded perspective view of an anchor member according to one embodiment.

FIG. 9 shows an alternative form of embodiment of the anchor member 10. In this instance, the threaded stud 38 is not welded directly to the bearing wall. Rather, it is screwed into a split nut 61 housed in a hollow base 62. The hollow base 62 containing the split nut 61 has been welded beforehand to the bearing wall. This simplifies the fitting of the threaded stud 38. FIG. 9 also shows a stack of Belleville washers inserted between the bearing plate 39 and the nut 40.

A packing-piece shim 63 is placed on the bearing wall around the hollow base 62 to accept the corners of the four adjacent universal insulating elements 8 that are going to rest thereon. The packing-piece shims 63 and the beads of mastic 60 compensate for flatness defects of the bearing wall and thus offer a flat upper surface on which to rest the universal insulating elements 8.

Furthermore, a positioning shim 64 projecting above the packing-piece shim 63 is mounted in the central opening of the packing-piece shim 63 around the hollow base 62. The positioning shims 64 act as end stops for positioning the corners of the universal insulating elements 8. More specifically, the longitudinal flange 125 exactly covers the length of the longitudinal side panel 121 and the transverse flange 126 exactly covers the length of the transverse side panel 122 which means that the vertical end surfaces of the longitudinal flange 125 and of the transverse flange 126 at the level of the corner form two orthogonal surfaces which can come into contact with two corresponding facets of the positioning shim 64, the periphery of which is octagonal.

FIGS. 6 to 8 also show that each corrugated metal sheet 12 comprises an offset in thickness in a raised border zone 66 along two out of four edges, the other two edges being flat. The raised border zone 66 serves to cover the flat border zone of an adjacent metal sheet 12 and will ultimately be welded thereto continuously in order to provide a sealed connection between the two metal sheets 12. The raised border zone 66 is obtained by a bending operation also referred to as joggling.

The technique described hereinabove for creating a tank that has just one sealed membrane may also be used in various types of tank, for example to form a double-membrane tank for liquefied natural gas (LNG) in a land facility or in a floating structure such as a methane tanker or the like. In this context, the sealed membrane illustrated in the preceding figures can be considered to be a secondary sealed membrane and it may be considered that a primary insulating barrier as well as a primary sealed membrane, neither depicted, also needs to be added to this secondary sealed membrane. In this way, this technique can also be applied to tanks exhibiting a plurality of thermally insulating barriers and of sealed membranes which are superposed.

A second embodiment of the flat wall of the tank, more particularly suited to a double-membrane tank, will now be described with reference to FIGS. 10 to 12.

Figure 12:
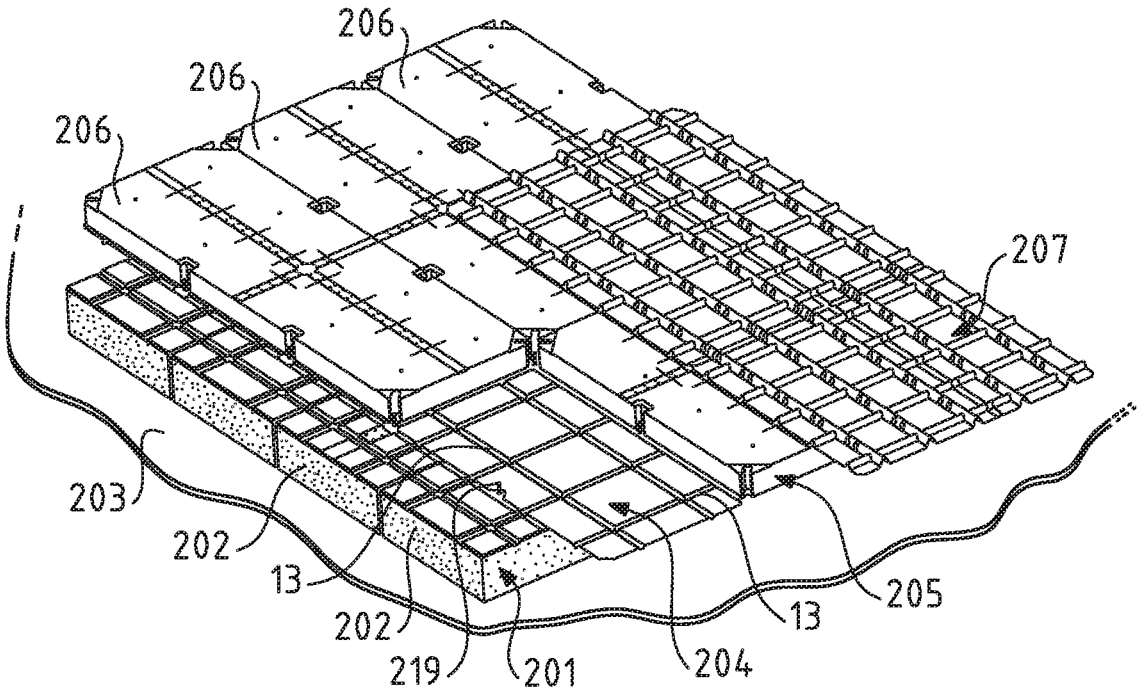
FIG. 12 is a perspective view of the flat wall of FIG. 10, also illustrating a primary thermally insulating barrier and a primary sealed membrane.

FIG. 12 depicts, in a cutaway view, the multilayer structure of a sealed and thermally insulating tank for storing a fluid.

Each wall of the tank comprises, from the outside toward the inside of the tank, a secondary thermally insulating barrier 201 comprising juxtaposed insulating blocks 202 fixed to the bearing structure 203, a secondary sealed membrane 204 borne by the insulating blocks 202 of the secondary thermally insulating barrier 201, a primary thermally insulating barrier 205 comprising juxtaposed insulating blocks 206 anchored to the insulating blocks 202 of the secondary thermally insulating barrier 201 by primary retaining members and a primary sealed membrane 207 borne by the insulating blocks 206 of the primary thermally insulating barrier 205 and intended to be in contact with the cryogenic fluid contained in the tank.

The bearing structure 203 may notably be self-supporting metal plating or, more generally, any type of rigid partition exhibiting suitable mechanical properties. The bearing structure 203 may notably be formed by the hull or double hull of a ship. The bearing structure 203 comprises a plurality of walls defining the overall shape of the tank, usually a polyhedral shape.

The secondary thermally insulating barrier 201 comprises a plurality of insulating blocks 202 bonded to the bearing structure 203 by means of adhesive beads of resin, not illustrated. The beads of resin need to be adhesive enough that they can, by themselves, anchor the insulating blocks 202. Alternatively, or in combination, the insulating blocks 202 may be anchored by means of the aforementioned anchor members 10 or of similar mechanical devices. The insulating blocks 202 are substantially in the shape of a rectangular parallelepiped.

Figure 11:
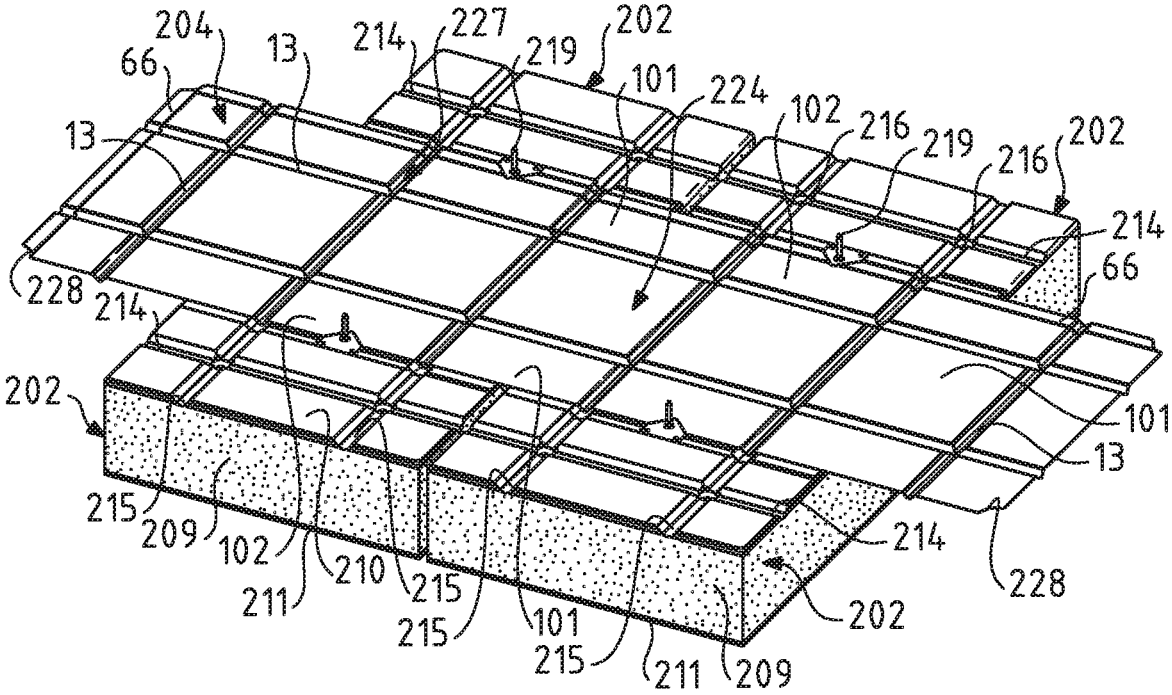
FIG. 11 is an enlarged perspective view of a detail of the flat wall of FIG. 10.

As illustrated in FIG. 11, the insulating blocks 202 each comprise a layer of insulating polymer foam 209 sandwiched between an internal rigid sheet 210, which constitutes a cover panel, and an external rigid sheet 211, which constitutes a bottom panel. The internal 210 and external 211 rigid sheets of the insulating blocks 202 are, for example, sheets of plywood bonded to said layer of insulating polymer foam 209. The insulating polymer foam may notably be a polyurethane-based foam. The polymer foam is advantageously reinforced with glass fibers that contribute to reducing its thermal contraction.

Figure 10:
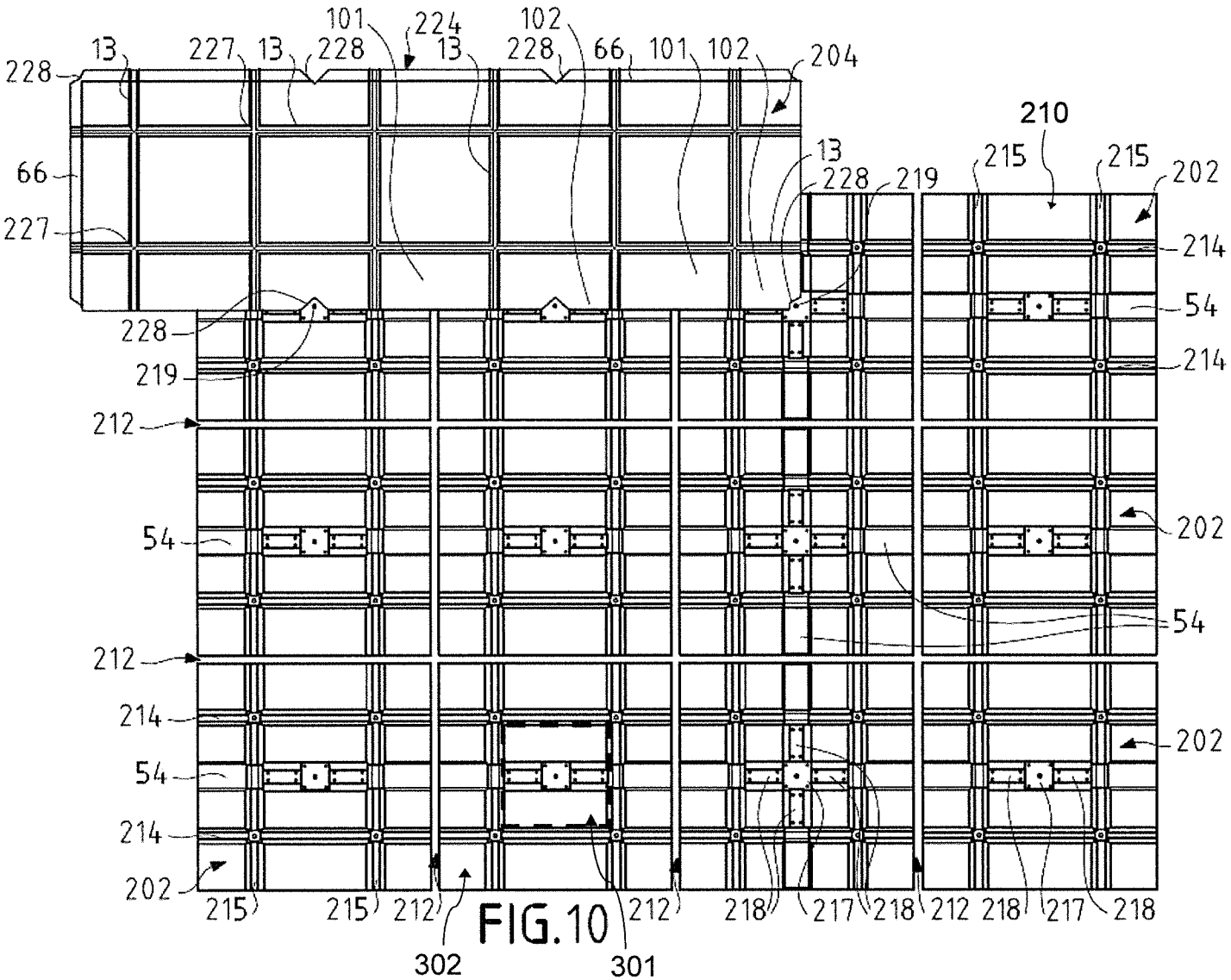
FIG. 10 is a plan view of a flat tank wall according to a second embodiment.

As illustrated in FIG. 10, the insulating blocks 202 are juxtaposed in parallel rows and separated from one another by gaps 212 that ensure a functional clearance for assembly. The gaps 212 are filled with an insulating filling, not depicted, such as glass wool, rock wool or open-cell flexible synthetic foam for example. The insulating filling is advantageously made from a porous material so as to leave spaces for gas to flow in the gaps 212 between the insulating blocks 202. Such gas flow spaces are advantageously used to allow the circulation of an inert gas, such as nitrogen, within the secondary thermally insulating barrier 201 so as to keep it under an inert atmosphere and thus avoid combustible gas finding itself in an explosive concentration range and/or so as to place the secondary thermally insulating barrier 201 at a reduced pressure so as to increase its insulating capability. This circulation of gas is also important for making it easier to detect potential leaks of combustible gas. The gaps 212 have, for example, a width of the order of 30 mm.

The internal sheet 210 has two series of two grooves 214 and 215 which are perpendicular to one another, so as to form a network of grooves. Each of the series of grooves 214 and 215 is parallel to two opposite sides of the insulating blocks 202. The grooves 214 and 215 are intended to accommodate corrugations, projecting toward the outside of the tank, formed on the metal plating of the secondary sealing barrier 204. More specifically, the internal sheet 210 comprises two grooves 214 extending in one direction of the insulating block 202 and two grooves 215 extending in the other direction of the insulating block 202, the dimensions of which are, as in the first embodiment, equal to two corrugations pitches by two corrugations pitches.

The grooves 214 and 215 pass right through the thickness of the internal sheet 210 and thus open onto the layer of insulating polymer foam 209. Moreover, the insulating blocks 202 comprise, in the zones where the grooves 214 and 215 cross, orifices 216 cutout in the layer of insulating polymer foam 209. The cutout orifices 216 are able to house the node zones formed at the intersections between the corrugations of the metal plating of the secondary sealing barrier 204. These node zones have a vertex projecting toward the outside of the tank.

Furthermore, as illustrated in FIG. 10, the internal sheet 210 is equipped with metal mounting plates 217 and 218, which constitute metal anchor pieces, for anchoring the edge of the corrugated metal plating of the secondary sealed membrane 204 to the insulating blocks 202. The metal mounting plates 217 and 218 are situated in the square central zone of the internal sheet 210, which constitutes an internal zone 301, which is delimited between the grooves 214 and 215 formed in the internal sheet 210. More specifically, the central metal mounting plate 217 has a square shape and is situated at the center of the internal sheet 210, whereas the two or four elongate mounting plates 218 are arranged around the central metal mounting plate 217 in the form of one or two strips passing completely across the square central zone of the internal sheet 210. In the marginal zones 302 of the internal sheet 210 which are situated between the grooves 214 and 215 and the edges of the internal sheet 210, thermal protection strips 54 are arranged in the continuation of the elongate mounting plates 218. The structure and function of the thermal protection strips 54 were described hereinabove.

FIG. 10 thus shows two types of insulating block 202. The insulating blocks 202 situated at the corners of the metal sheets 224, of rectangular shape, forming the secondary sealed membrane 204 bear four elongate mounting plates 218, thus forming two perpendicular strips which cross at the level of the central mounting plate 217, and which are respectively parallel to the two edges of the metal sheet 224. The insulating blocks 202 situated at the edges of the metal sheets 224, away from the corners, bear just two elongate mounting plates 218, thus forming a strip parallel to the edge of the metal sheet 224.

As an alternative, all the insulating blocks 202 could bear the four elongate mounting plates 218, for the sake of standardizing production.

The metal mounting plates 217 and 218 are fixed to the internal sheet 210 of the insulating block 202 by screws, rivets, staples, by bonding or by a combination of a number of these means, for example. The metal mounting plates 217 and 218 are fitted into recesses formed in the internal sheet 210 in such a way that the internal surface of the metal mounting plates 217 and 218 lies flush with the internal surface of the internal sheet 210.

The internal sheet 210 is also equipped with threaded metal studs 219 projecting toward the inside of the tank and intended for fixing the primary thermally insulating barrier 205 to the insulating blocks 202 of the secondary thermally insulating barrier 201. The studs 219 pass through orifices formed in the metal mounting plates 217.

In conjunction with FIGS. 10 to 12, it may be seen that the secondary sealing barrier comprises a plurality of corrugated metal sheets 224 each of substantially rectangular shape. The corrugated metal sheets 224 are arranged in an offset manner with respect to the insulating panels 202 of the secondary thermally insulating barrier 201 so that each of said corrugated metal sheets 224 extends jointly over at least four adjacent insulating panels 202.

Each corrugated metal sheet 224 has a first series of parallel corrugations 13 extending in a first direction and a second series of parallel corrugations 13 extending in a second direction. The directions of the series of corrugations 13 are perpendicular. Each of the series of corrugations 13 is parallel to two opposite edges of the corrugated metal sheet 224. The corrugations 13 here project toward the outside of the tank, namely toward the bearing structure 203. The corrugated metal sheet 224 comprises a plurality of flat portions between the corrugations 13. At each intersection of two corrugations 13, the metal plating comprises a node zone 227. The node zone 227 comprises a central portion having a vertex projecting toward the outside of the tank.

In the embodiment depicted, the corrugations 13 of the first series and of the second series have identical heights. As in the first embodiment, it is, however, possible to plan for the corrugations 13 of the first series to have a greater height than the corrugations 13 of the second series, or vice versa.

As depicted in FIG. 11, the corrugations 13 of the corrugated metal sheets 224 are housed in the grooves 214 and 215 formed in the internal sheet 210 of the insulating panels 202. The adjacent corrugated metal sheets 224 are welded together with overlap at the raised border zone 66 described previously. The corrugated metal sheets 224 are anchored to the metal mounting plates 217 and 218 by spot welds.

The corrugated metal sheets 224 comprise, along their longitudinal edges and at their four corners, cutouts 228 for the passage of the studs 219 intended to fix the primary thermally insulating barrier 205 to the secondary thermally insulating barrier 201.

The corrugated metal sheets 224 are, for example, made of Invar®: namely an alloy of iron and of nickel the coefficient of expansion of which is typically comprised between $1.2\times10^{-6}$ and $2\times10^{-6}$ $K^{-1}$, or from an iron alloy with a high manganese content the coefficient of expansion of which is typically of the order of $7\times10^{-6}$ $K^{-1}$. Alternatively, the corrugated metal sheets 224 may equally be made of stainless steel or of aluminum.

The lengths and widths of the corrugated metal sheets 224 are sized as for the metal sheets 12 of the first embodiment, for the same reasons. In FIGS. 10 and 11, the single metal sheet 224 depicted has dimensions of two corrugations pitches by six corrugations pitches. The metal sheet 224 thus exhibits an alternation of non-fixed flat portions 101 and of fixed flat portions 102, as described hereinabove.

In the event (not depicted) that the sealed membrane 204 is produced using metal sheets 224 that are larger than two corrugations pitches in the two directions of the plane, it is necessary to make additional openings in the flat portions situated away from the edges of the metal sheet 224 in order to allow the passage of the studs 219, and to weld the edges of these openings in a sealed manner to the underlying metal mounting plates 217.

Dimensioned Example

In one exemplary embodiment, the dimensions of the insulating block 202 are: width 990 mm, length 990 mm, for a corrugations pitch of 510 mm in both directions and a 30 mm gap between the insulating blocks. The corrugations pitch can be modified according to the requirements in terms of the flexibility of the sealed membrane, which involves modifying the dimension of the insulating block 202 accordingly.

In order to create the primary thermally insulating barrier 205 and the primary sealed membrane 207 there are different known techniques that can be used.

As depicted in FIG. 12, the primary thermally insulating barrier 205 here comprises a plurality of insulating panels 206 of substantially rectangular parallelepipedal shape. The insulating panels 206 are offset with respect to the insulating blocks 202 of the secondary thermally insulating barrier 201 so that each insulating panel 206 extends over, in this instance, eight insulating blocks 202 of the secondary thermally insulating barrier 201. Further details on the creation of the primary thermally insulating barrier 205 and of the primary sealed membrane 207 can be found in publication WO-A-2016046487.

In the secondary sealed membrane 204 just as in the sealed membrane of the first embodiment, an even distribution of the deformations of the corrugations is achieved by virtue of the sizing of the insulating blocks and of the anchoring of the sealed membrane thereto.

In comparison with the embodiments illustrated hereinabove, one of the two series of corrugations of the sealed membrane can be omitted, for example for applications in which membrane flexibility is desired in just one direction of the plane. In such an instance, the dimensional symmetries of the tank wall which were described hereinabove are still needed in only one direction of the plane and the sizing referring to the corrugations pitch of the series of corrugations which has now been omitted of course becomes superfluous, or at the least optional.

Figure 13:
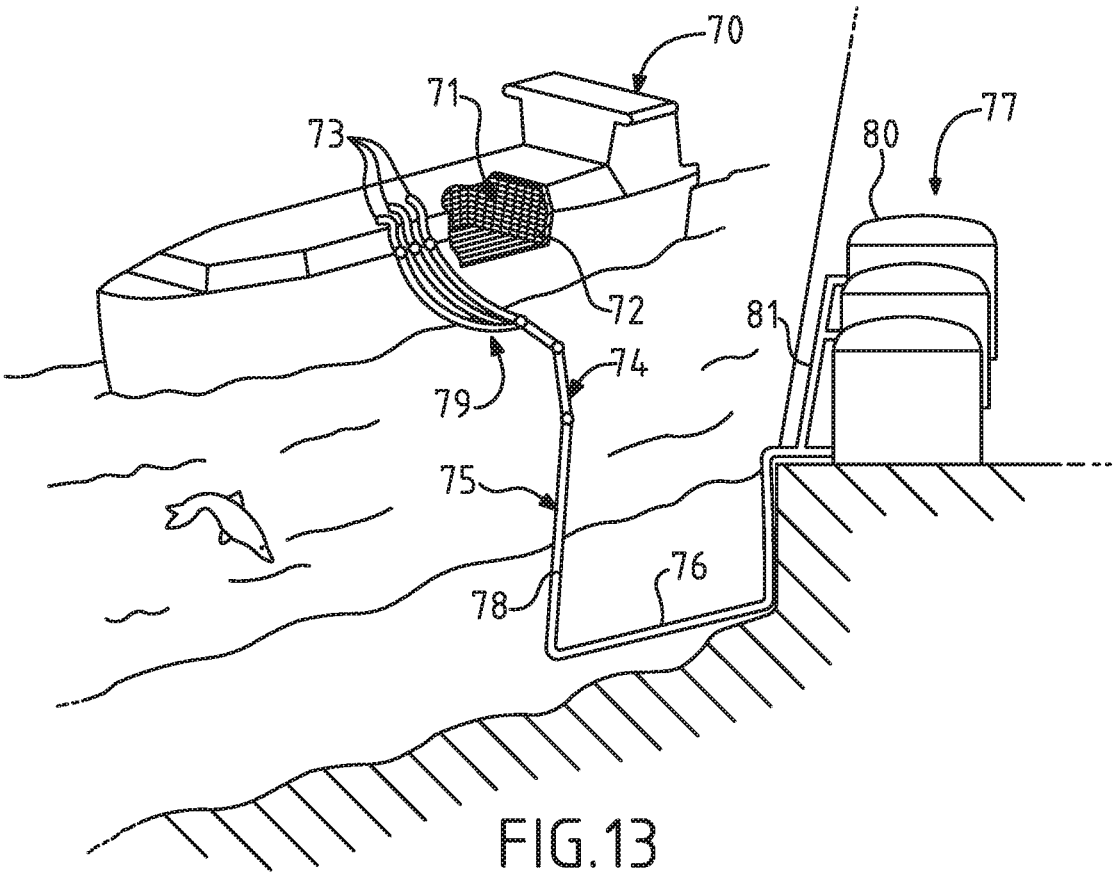
FIG. 13 is a schematic depiction with cutaway of a tank of a methane tanker or LPG tanker and of a terminal for loading/unloading this tank.

With reference to FIG. 13, a cutaway view of a methane tanker 70 shows a sealed and insulated tank 71 of prismatic overall shape mounted in the double hull 72 of the ship. The wall of the tank 71 comprises a primary sealed barrier intended to be in contact with the liquefied gas contained in the tank, a secondary sealed barrier arranged between the primary sealed barrier and the double hull 72 of the ship, and two insulating barriers arranged respectively between the primary sealed barrier and the secondary sealed barrier, and between the secondary sealed barrier and the double hull 72. In a simplified version, the ship comprises a single hull.

In a way known per se, loading/unloading pipework 73 arranged on the upper deck of the ship can be connected, by means of suitable connectors, to a maritime or harbor terminal in order to transfer a cargo of liquefied gas from or to the tank 71.

FIG. 13 depicts one example of a maritime terminal comprising a loading and unloading station 75, an underwater pipe 76 and an on-shore facility 77. The loading and unloading station 75 is a fixed offshore installation comprising a mobile arm 74 and a tower 78 supporting the mobile arm 74. The mobile arm 74 supports a bundle of insulated flexible pipes 79 which can be connected to the loading/unloading pipework 73. The orientable mobile arm 74 can adapt to suit all sizes of methane tanker. A connecting pipe, not depicted, extends up inside the tower 78. The loading and unloading station 75 allows the methane tanker 70 to be loaded and unloaded from or to the on-shore facility 77. The latter comprises liquefied-gas storage tanks 80 and connecting pipes 81 connected by the underwater pipe 76 to the loading or unloading station 75. The underwater pipe 76 allows the liquefied gas to be transferred between the loading or unloading station 75 and the on-shore facility 77 over a long distance, for example 5 km, allowing the methane tanker 70 to be kept standing off shore by a long distance during the loading and unloading operations.

In order to generate the pressure needed for transferring the liquefied gas, use is made of the pumps carried on board the ship 70 and/or of the pumps with which the on-shore facility 77 is equipped and/or of the pumps with which the loading and unloading station 75 is equipped.

Even though the invention has been described in conjunction with a number of particular embodiments, it is quite obvious that it is not in any way restricted thereto and that it comprises all technical equivalents of the means described and combinations thereof where these fall within the scope of the invention.

The use of the verbs "to comprise", "to exhibit" or "to include" and of the conjugated forms thereof does not exclude the presence of elements or steps other than those listed in a claim. The use of the indefinite article "a" or "an" for an element or a step does not exclude, unless mentioned otherwise, the presence of a plurality of such elements or steps.

In the claims, any reference symbol between parentheses should not be interpreted as imposing a limitation on the claim.

The invention claimed is:

1. A sealed and thermally insulating tank incorporated into a bearing structure, the tank comprising a tank wall fixed to a bearing wall of the bearing structure, wherein the tank wall comprises:

a thermally insulating barrier fixed to the bearing wall, the thermally insulating barrier comprising a plurality of rectangular parallelepipedal insulating blocks juxtaposed in a regular rectangular grid pattern, each rectangular parallelepipedal insulating block comprising an insulating filling and a cover panel facing toward the inside of the tank, an upper face of the cover panel on the opposite side to the insulating filling bearing a metal anchor piece and a sealed membrane borne by the thermally insulating barrier and made up of a corrugated metal membrane comprising a first series of parallel corrugations and flat portions situated between the parallel corrugations and resting on the upper face of the cover panels, the parallel corrugations being arranged parallel to a first direction of the rectangular parallelepipedal insulating blocks and spaced by a first corrugations pitch, wherein the rectangular parallelepipedal insulating blocks each have a dimension extending in a second direction perpendicular to the first direction, which is equal to twice the first corrugations pitch, which means that each of the rectangular parallelepipedal insulating blocks has a respective pair of corrugations of the first series of parallel corrugations situated thereon, wherein the flat portions of the sealed membrane comprise a first flat portion borne by an internal zone of the cover panel and second flat portions borne by first marginal zones of the cover panel, the internal zone being defined as an area situated between the pair of corrugations of the first series of parallel corrugations on the cover panel, the first marginal zones being defined as areas situated between the internal zone and the edges of the cover panel that are parallel to the first direction, wherein the metal anchor piece of each rectangular parallelepipedal insulating block is arranged at least in the internal zone of the cover panel, wherein the sealed membrane being is fixed to the thermally insulating barrier by fixing the first flat portions of the sealed membrane to the metal anchor pieces of a plurality of the rectangular parallelepipedal insulating blocks only in the internal zones of the cover panels, and wherein the second flat portions of the sealed membrane are not fixed to the thermally insulating barrier in the first marginal zones of the cover panels, so that the sealed membrane is not fixed to the thermally insulating barrier in the first marginal zones of the cover panels.

2. The tank as claimed in claim 1, wherein the metal anchor piece is interrupted some distance from the edges of the cover panel parallel to the first direction and is confined to the internal zone of the cover panel, and wherein the tank further comprises two thermal protection strips arranged on the cover panel in the first marginal zone of the cover panel between the metal anchor piece and the edges of the cover panel parallel to the first direction, and wherein the pair of corrugations of the first series of corrugations are situated one on each side of the metal anchor piece for each of the rectangular parallelepipedal insulating blocks.

3. The tank as claimed in claim 1, wherein there is an offset equal to substantially half the first corrugations pitch between the corrugations parallel to the first direction and the edges of the rectangular parallelepipedal insulating blocks parallel to the first direction.

4. The tank as claimed in claim 1, wherein the metal anchor piece is arranged at a center of the cover panel and the pair of corrugations of the first series of corrugations are situated at equal distances from the center of the cover panel.

5. The tank as claimed in claim 1, wherein the corrugated metal membrane comprises a plurality of corrugated metal sheets of rectangular shape, each corrugated metal sheet comprising two edges parallel to the first direction and two edges parallel to the second direction, the dimension of a corrugated metal sheet in the second direction being equal to an even integer multiple of the first corrugations pitch, and wherein the two edges of the corrugated metal sheet that are parallel to the first direction are essentially situated in the first flat portions of the corrugated metal sheet between the corrugations parallel to the first direction and pass over the metal anchor pieces of the rectangular parallelepipedal insulating blocks in the internal zones of the cover panels.

6. The tank as claimed in claim 5, wherein each corrugated metal sheet of rectangular shape has a border zone lap-welded to a border zone of the adjacent corrugated metal sheets, the border zone of a corrugated metal sheet situated on top being welded each time to the border zone of an adjacent corrugated metal sheet situated underneath, and wherein, along the edges of the corrugated metal sheet that are parallel to the first direction, the border zone of the corrugated metal sheet situated underneath is welded to the metal anchor pieces of the rectangular parallelepipedal insulating blocks in the internal zones of the cover panels.

7. The tank as claimed in claim 5, wherein the dimension of a corrugated metal sheet in the second direction and/or in the first direction is equal to twice the first corrugations pitch.

8. The tank as claimed in claim 5, wherein the metal anchor piece comprises a metal strip running parallel to the second direction.

9. The tank as claimed in claim 8, wherein the metal anchor piece comprises a first metal strip parallel to the first direction and a second metal strip parallel to the second direction, which first and second strips form a cross in the internal zone of the cover panel.

10. The tank as claimed in claim 1, wherein the sealed membrane further comprises a second series of parallel corrugations, which are arranged parallel to the second direction of the rectangular parallelepipedal insulating blocks and spaced apart by a second corrugations pitch, said first and second flat portions of the sealed membrane being furthermore situated between the corrugations parallel to the second direction, wherein the rectangular parallelepipedal insulating blocks each have a dimension extending in the first direction, which is is equal to twice the second corrugations pitch, which means that each of the rectangular parallelepipedal insulating blocks has a respective pair of corrugations of the second series of parallel corrugations situated thereon, wherein the internal zone is further defined as an area situated between the pair of corrugations of the second series of parallel corrugations on the cover panel, and the cover panel further comprises second marginal zones being defined as areas situated between the internal zone and the edges of the cover panel that are parallel to the second direction.

11. The tank as claimed in claim 10, wherein the metal anchor piece is interrupted some distance from the edges of the cover panel and is confined to the internal zone of the cover panel, and wherein the pair of corrugations of the second series of corrugations are situated one on each side of the metal anchor piece of each of the rectangular parallelepipedal insulating blocks.

12. The tank as claimed in claim 10, wherein there is an offset equal to substantially half the second corrugations pitch between the corrugations parallel to the second direction and the edges of the rectangular parallelepipedal insulating blocks parallel to the second direction.

13. The tank as claimed in claim 10, wherein the corrugated metal membrane comprises a plurality of corrugated metal sheets of rectangular shape, each corrugated metal sheet comprising two edges parallel to the first direction and two edges parallel to the second direction, the dimension of a corrugated metal sheet in the first direction being equal to an even integer multiple of the second corrugations pitch, and wherein the two edges of the corrugated metal sheet that are parallel to the second direction are essentially situated in the flat portions of the corrugated metal sheet between the corrugations parallel to the second direction and pass over the metal anchor pieces of the rectangular parallelepipedal insulating blocks in the internal zone of the cover panels.

14. The tank as claimed in claim 10, wherein the first corrugations pitch is equal to the second corrugations pitch and the rectangular parallelepipedal insulating blocks have a square outline.

15. The tank as claimed in claim 1, wherein each rectangular parallelepipedal insulating block comprises a bottom panel and a block of foam interposed between the bottom panel and the cover panel and forming said insulating filling.

16. The tank as claimed in claim 1, wherein each rectangular parallelepipedal insulating block comprises a box structure wherein the insulating filling is housed, said box structure comprising a bottom panel and side panels extending between said bottom panel and the cover panel.

17. The tank as claimed in claim 1, wherein the corrugations project toward the inside of the tank with respect to the first flat portions.

18. The tank as claimed in claim 1, wherein the corrugations project toward the outside of the tank with respect to the first flat portions, and are housed in grooves formed in the cover panels of the rectangular parallelepipedal insulating blocks.

19. The tank as claimed in claim 1, wherein the thermally insulating barrier is a secondary thermally insulating barrier and the sealed membrane is a secondary sealed membrane, the tank wall further comprising a primary thermally insulating barrier arranged on the secondary sealed membrane and a primary sealed membrane borne by said primary thermally insulating barrier, and wherein the metal anchor pieces of the rectangular parallelepipedal insulating blocks of the secondary thermally insulating barrier bear primary retaining members, the primary thermally insulating barrier comprising a plurality of juxtaposed rectangular parallelepipedal insulating blocks anchored to the primary retaining members.

20. The tank as claimed in claim 19, wherein the secondary sealed membrane comprises cutouts to allow the primary retaining members to project above the secondary sealed membrane, and wherein edges of the cutouts in the secondary sealed membrane are welded in a sealed manner to the metal anchor pieces of the rectangular parallelepipedal insulating blocks of the secondary thermally insulating barrier all around the primary retaining members.

21. The tank as claimed in claim 1, wherein the metal anchor piece extends over an entire dimension of the cover panel in the second direction, including in said marginal zones of the cover panel situated between the internal zone and the edges of the cover panel that are parallel to the first direction, the sealed membrane being fixed to the metal anchor piece only in the internal zone of the cover panel and not in said marginal zones of the cover panel.

22. The tank as claimed in claim 1, wherein the second flat portions are slidable over the cover panel.

23. A ship for transporting a liquid product, the ship comprising a hull and a tank as claimed in claim 1, wherein the hull comprises the bearing structure of the tank.

24. A method for loading or unloading a ship as claimed in claim 23, the method comprising conveying a liquid product through insulated pipes from or to a floating or land storage facility to or from the tank of the ship.

25. A transfer system for a liquid product, the system comprising a ship as claimed in claim 23, insulated pipes arranged in such a way as to connect the tank installed in the hull of the ship to a floating or land storage facility and a pump for causing a liquid product to flow through the insulated pipes from or to the floating or land storage facility to or from the tank of the ship.

* * * * *